US009711158B2

(12) United States Patent
Moriya et al.

(10) Patent No.: US 9,711,158 B2
(45) Date of Patent: Jul. 18, 2017

(54) ENCODING METHOD, ENCODER, PERIODIC FEATURE AMOUNT DETERMINATION METHOD, PERIODIC FEATURE AMOUNT DETERMINATION APPARATUS, PROGRAM AND RECORDING MEDIUM

(75) Inventors: Takehiro Moriya, Kanagawa (JP); Noboru Harada, Kanagawa (JP); Yusuke Hiwasaki, Tokyo (JP); Yutaka Kamamoto, Kanagawa (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 16 days.

(21) Appl. No.: 13/981,125

(22) PCT Filed: Jan. 18, 2012

(86) PCT No.: PCT/JP2012/050970
§ 371 (c)(1),
(2), (4) Date: Jul. 23, 2013

(87) PCT Pub. No.: WO2012/102149
PCT Pub. Date: Aug. 2, 2012

(65) Prior Publication Data

US 2013/0311192 A1 Nov. 21, 2013

(30) Foreign Application Priority Data

Jan. 25, 2011 (JP) ..... 2011-013426

(51) Int. Cl.
*G10L 19/00* (2013.01)
*G10L 19/04* (2013.01)
(Continued)

(52) U.S. Cl.
CPC ..... *G10L 19/04* (2013.01); *G10L 19/0212* (2013.01); *G10L 25/90* (2013.01)

(58) Field of Classification Search
CPC ..... G10L 19/01212; G10L 19/18; G10L 19/0017; G10L 19/008; G10L 19/173;
(Continued)

(56) References Cited

U.S. PATENT DOCUMENTS 5,848,387 A * 12/1998 Nishiguchi et al. ..... 704/214
5,878,388 A * 3/1999 Nishiguchi et al. ..... 704/214
(Continued)

FOREIGN PATENT DOCUMENTS

JP 11 052994 2/1999
JP 2006 126592 5/2006
(Continued)

OTHER PUBLICATIONS

Japanese Office Action issued Jun. 3, 2014, in Japan Patent Application No. 2012-554739 (with English translation).
(Continued)

*Primary Examiner* — Vijay B Chawan
(74) *Attorney, Agent, or Firm* — Oblon, McClelland, Maier & Neustadt, L.L.P.

(57) ABSTRACT

An encoding technique encoding a sound signal at a low bit rate with reduced processing. The technique includes: an interval determination determining an interval T between samples corresponding to periodicity of an audio signal or an integer multiple of a fundamental frequency of the audio signal from a set S of candidates for the interval T; and a side information generating encoding the determined interval T to obtain side information. The interval determining determines the interval T from a set S of Y candidates (Y<Z) including $Z_2$ candidates ($Z_2$<Z) selected from among Z candidates for the interval T representable with the side
(Continued)

information without depending on a candidate subjected to the interval determination in a previous frame a predetermined number of frames before the current frame and including a candidate subjected to the interval determination in the previous frame the predetermined number of frames before the current frame.

22 Claims, 10 Drawing Sheets

(51) Int. Cl.
*G10L 19/02* (2013.01)
*G10L 25/90* (2013.01)

(58) Field of Classification Search
CPC ..... G10L 19/022; G10L 19/038; G10L 21/04; G10L 25/90; G10L 19/0208; G10L 19/035; G10L 25/93; G10L 19/0212; H04B 1/665; H04B 1/667
USPC .... 704/200.1, 500–504, 229, 205, 207, 230, 704/219, 220, 203, 208, 223; 345/473; 375/240.27, 240.16, 242; 370/412, 513; 381/22.23
See application file for complete search history.

(56) References Cited

U.S. PATENT DOCUMENTS

| | | | | |
|---|---|---|---|---|
| 6,587,816 | B1 | 7/2003 | Chazan et al. | |
| 6,647,063 | B1 * | 11/2003 | Oikawa | 375/242 |
| 8,321,210 | B2 * | 11/2012 | Grill et al. | 704/205 |
| 8,930,198 | B2 * | 1/2015 | Grill et al. | 704/500 |
| 9,043,216 | B2 * | 5/2015 | Bayer | G10L 19/167 704/216 |
| 2002/0023116 | A1 * | 2/2002 | Kikuchi et al. | 708/402 |
| 2003/0088400 | A1 * | 5/2003 | Nishio et al. | 704/201 |
| 2007/0016418 | A1 * | 1/2007 | Mehrotra et al. | 704/240 |
| 2008/0162121 | A1 | 7/2008 | Son et al. | |
| 2011/0158415 | A1 * | 6/2011 | Bayer et al. | 381/22 |
| 2011/0161088 | A1 * | 6/2011 | Bayer et al. | 704/500 |
| 2011/0202355 | A1 * | 8/2011 | Grill et al. | 704/500 |
| 2012/0029926 | A1 * | 2/2012 | Krishnan et al. | 704/500 |
| 2013/0066640 | A1 * | 3/2013 | Grill et al. | 704/500 |

FOREIGN PATENT DOCUMENTS

| | | | |
|---|---|---|---|
| JP | 2009 156971 | | 7/2009 |
| KR | 10-2004-0105741 | | 12/2004 |
| KR | 10-2008-0061758 | A | 7/2008 |
| WO | WO 03/077235 | A1 | 9/2003 |
| WO | WO 2008/082133 | A1 | 7/2008 |
| WO | WO 2009/155569 | A1 | 12/2009 |
| WO | WO 2011/056397 | A1 | 5/2011 |

OTHER PUBLICATIONS

Combined Chinese Office Action and Search Report issued Jul. 24, 2014 in Patent Application No. 201280006378.1 with English Translation.
Office Action issued Jan. 5, 2015 in Korean Patent Application No. 10-2013-7019179 (with English language translation).
Moriya T. et al , A Design of Transform Coder for Both Speech and Audio Signals at 1 bit/sample', Proc. ICASSP'97, pp. 1371-1374, 1997.
Herre J. et al., "The Integrated Filterbank Based Scalable MPEG-4 Audio Coder,", 105$^{th}$ Convention Audio Engineering Society, 4810 (L-4), Total pages 20, 1998.
International Search Report Issued Apr. 17, 2012 in PCT/JP12/50970 Filed Janaury 18, 2012.
Extended European Search Report issued Oct. 8, 2014 in Patent Application No. 12739924.4.
Office Action issued Jun. 23, 2015, in Korean Patent Application No. 10-2012-7019179 (with English-language translation).
Search Report issued Oct. 8, 2014, in European Patent Application No. 12739924.4.
Office Action issued Mar. 30,2016 in Korean Patent Application No. 10-2013-7019179 (with English language translation).
Office Action issued Jul. 28, 2016, in Korean Patent Application No. 10-2016-7017192 (with English-translation).

* cited by examiner

ENCODING METHOD, ENCODER, PERIODIC FEATURE AMOUNT DETERMINATION METHOD, PERIODIC FEATURE AMOUNT DETERMINATION APPARATUS, PROGRAM AND RECORDING MEDIUM

TECHNICAL FIELD

The present invention relates to a technique to encode audio signal and, in particular, to encoding of sample strings in a frequency domain that is obtained by transforming audio signal into the frequency domain and to a technique to determine a periodic feature amount (for example a fundamental frequency or a pitch period) which can be used as an indicator for rearranging sample strings in the encoding.

BACKGROUND ART

Adaptive coding that encodes orthogonal coefficients such as DFT (Discrete Fourier Transform) and MDCT (Modified Discrete Cosine Transform) coefficients is known as a method for encoding speech signals and audio signals at low bit rates (for example about 10 to 20 kbits/s). For example, AMR-WB+ (Extended Adaptive Multi-Rate Wideband), which is a standard technique, has the TCX (transform coded excitation) coding mode in which DFT coefficients are normalized and vector-quantized every 8 samples.

In TwinVQ (Transform domain Weighted Interleave Vector Quantization), all MDCT coefficients are rearranged according to a fixed rule and the resulting collection of samples is combined into vectors and encoded. In some cases of TwinVQ, a method is used in which large components are extracted from the MDCT coefficients, for example, in every pitch period, information corresponding to the pitch period is encoded, the remaining MDCT coefficient strings after the extraction of the large components in every pitch period are rearranged, and the rearranged MDCT coefficient strings are vector-quantized every predetermined number of samples. Examples of references on TwinVQ include Non-patent literatures 1 and 2.

An example of technique to extract samples at regular intervals for encoding is the one disclosed in Patent literature 1.

PRIOR ART LITERATURE

Patent Literature

Patent literature 1: Japanese Patent Application Laid-Open No. 2009-156971

Non-Patent Literature

Non-patent literature 1: T. Moriya, N. Iwakami, A. Jin, K. Ikeda, and S. Mild, "A Design of Transform Coder for Both Speech and Audio Signals at 1 bit/sample," Proc. ICASSP '97, pp. 1371-1384, 1997.

Non-patent literature 2: J. Herre, E. Allamanche, K. Brandenburg, M. Dietz, B. Teichmann, B. Grill, A. Jin, T. Moriya, N. Iwakami, T. Norimatsu, M. Tsushima, T. Ishikawa, "The Integrated Filterbank Based Scalable MPEG-4, Audio Coder," 105th Convention Audio Engineering Society, 4810, 1998.

SUMMARY OT THE INVENTION

Problem to be Solved by the Invention

Since encoding based on TCX, such as AMR-WB+, does not take into consideration variations in amplitude of frequency-domain coefficients based on periodicity, the efficiency of encoding decreases when varying amplitudes are coded together. There are variations of quantization and encoding based on TCX. Here, an example is considered in which entropy coding is applied to a series of MDCT coefficients that are discrete values obtained by quantization and arranged in ascending order of frequency to achieve compression. In this case, a plurality of samples are treated as one symbol (encoding unit) and a code to be assigned to a symbol is adaptively controlled depending on the symbol immediately preceding that symbol. In general, shorter codes are assigned to symbols with smaller amplitudes and longer codes are assigned to symbols with greater amplitudes. Since codes to be assigned are adaptively controlled depending on the immediately preceding symbol, continually shortening codes are assigned when values with small amplitudes appear in succession. When a sample with a far greater amplitude appears abruptly after a sample with a small amplitude, a very long code is assigned to that sample.

The conventional TwinVQ was designed on the assumption that fixed-length-code vector quantization is used, where codes with a uniform length are assigned to every vector made up of given samples, and was not intended to be used for encoding MDCT coefficients by variable-length coding.

In light of the technical background described above, an object of the present invention is to provide an encoding technique that improves the quality of discrete signals, especially speech/audio digital signals, encoded by low-bit-rate coding with a small amount of computation and to provide a technique to determine a periodic feature amount which can be used as an indicator for rearranging sample strings in the encoding.

Means to Solve the Problems

According to an encoding technique of the present invention, an encoding method for encoding a sample string in a frequency domain that is derived from an audio signal in frames includes an interval determination step of determining an interval T between samples that correspond to a periodicity of the audio signal or to an integer multiple of a fundamental frequency of the audio signal from a set S of candidates for the interval T, a side information generating step of encoding the interval T determined at the interval determination step to obtain side information, and a sample string encoding step of encoding a rearranged sample string to obtain a code string, the rearranged sample string (1) including all of the samples in the sample string and (2) being a sample string in which at least some of the sample strings are rearranged so that all or some of one or a plurality of successive samples including a sample corresponding to the periodicity or the fundamental frequency of the audio signal in the sample string and one or a plurality of successive samples including a sample corresponding to an integer multiple of the periodicity or the fundamental frequency of the audio signal in the sample string are gathered together into a cluster on the basis of the interval T determined by the interval determination step. In the interval determination step, the interval T is determined from a set S made up of Y candidates (where $Y<Z$) among Z candidates for the interval T representable with the side information, the Y candidates including $Z_2$ candidates (where $Z_2<Z$) selected without depending on a candidate subjected to the interval determination step in a previous frame a predetermined number of frames before the current frame and including a candidate subjected to the interval determination step in the previous frame the predetermined number of frames before the current frame.

The interval determining step may further include an adding step of adding to the set S a value adjacent to a candidate subjected to the interval determination step in a previous frame the predetermined number of frames before the current frame and/or a value having a predetermined difference from the candidate.

The interval determination step may further include a preliminary selection step of selecting some of $Z_1$ candidates among the Z candidates for the interval T representable with the side information as the $Z_2$ candidates on the basis of an indicator obtainable from the audio signal and/or sample string in the current frame, where $Z_2<Z_1$.

The interval determination step may further include a preliminary selection step of selecting some of $Z_1$ candidates among the Z candidates for the interval T representable with the side information on the basis of an indicator obtainable from the audio signal and/or sample string in the current frame and a second adding step of selecting, as the $Z_2$ candidates, a set of a candidate selected at the preliminary selection step and a value adjacent to the candidate selected at the preliminary selection step and/or a value having a predetermined difference from the candidate selected at the preliminary selection step.

The interval determination step may include a second preliminary selection step of selecting some of candidates for the interval T that are included in the set S on the basis of an indicator obtainable from the audio signal and/or sample string in the current frame and a final selection step of determining the interval T from a set made up of some of the candidates selected at the second preliminary selection step.

A configuration is also possible where the greater an indicator indicating the degree of stationarity of the audio signal in the current frame, the greater the proportion of candidates subjected to the interval determination step in the previous frame the predetermined number of frames before the current frame to the set S is.

A configuration is also possible where when the indicator indicating the degree of stationarity of the audio signal in the current frame is smaller than a predetermined threshold, only the $Z_2$ candidates are included in the set S.

The indicator indicating the degree of stationarity of the audio signal in the current frame increases when at least one of the following conditions is satisfied.

(a-1) A "prediction gain of the audio signal in the current frame" increases, (a-2) an "estimated prediction gain of the audio signal in the current frame" increases, (b-1) the difference between a "prediction gain of the audio signal in the frame immediately preceding the current frame" and the "prediction gain of the audio signal in the current frame" decreases, (b-2) the difference between an "estimated prediction gain in the immediately preceding frame" and the "estimated prediction gain in the current frame" decreases, (c-1) the "sum of amplitudes of samples of the audio signal included in the current frame" increases, (c-2) the "sum of amplitudes of samples included in a sample string obtained by transforming a sample string of the audio signal included in the current frame into a frequency domain" increases, (d-1) the difference between the "sum of amplitudes of samples of the audio signal included in the immediately preceding frame" and the "sum of amplitudes of samples of the audio signal included in the current frame" decreases, (d-2) the difference between the "sum of amplitudes of samples included in a sample string obtained by transforming a sample string of the audio signal included in the immediately preceding frame into a frequency domain" and the "sum of amplitudes of samples included in a sample string obtained by transforming a sample string of the audio signal included in the current frame into a frequency domain" decreases, (e-1) "power of the audio signal in the current frame" increases, (e-2) "power of a sample string obtained by transforming a sample string of the audio signal in the current frame into a frequency domain" increases, (f-1) the difference between "power of the audio signal in the immediately preceding frame" and "power of the audio signal in the current frame" decreases, and (f-2) the difference between "power of a sample string obtained by transforming a sample string of the audio signal in the immediately preceding frame into a frequency domain" and "power of a sample string obtained by transforming a sample string of the audio signal in the current frame into a frequency domain" decreases.

The sample string encoding step may include a step of outputting the code string obtained by encoding the sample string before being rearranged, or the code string obtained by encoding the rearranged sample string and the side information, whichever has a smaller code amount.

The sample string encoding step may output the code string obtained by encoding the rearranged sample string and the side information when the sum of the code amount of or an estimated value of the code amount of the code string obtained by encoding the rearranged sample string and the code amount of the side information is smaller than the code amount of or an estimated value of the code amount of the code string obtained by encoding the sample string before being rearranged, and may output the code string obtained by encoding the sample string before being rearranged when the code amount of or an estimated value of the code amount of the code string obtained by encoding the sample string before being rearranged is smaller than the sum of the code amount of or an estimated value of the code amount of the code string obtained by encoding the rearranged sample string and the code amount of the side information.

The proportion of candidates subjected to the interval determination step in the previous frame the predetermined number of frames before the current frame to the set S may be greater when a code string output in the immediately preceding frame is a code string obtained by encoding a rearranged sample string than when a code string output in the immediately preceding frame is a code string obtained by encoding a sample string before being rearranged.

A configuration is also possible where when a code string output in the immediately preceding frame is a code string obtained by encoding a sample string being rearranged, the set S includes only the $Z_2$ candidates.

A configuration is also possible where when the current frame is a temporally first frame, or when the immediately preceding frame is coded by an encoding method different from the encoding method of the present invention, or when a code string output in the immediately preceding frame is a code string obtained by encoding a sample string being rearranged, the set S includes only the $Z_2$ candidates.

A method for determining a periodic feature amount of an audio signal in frames according to the present invention includes a periodic feature amount determination step of determining a periodic feature amount of the audio signal from a set of candidates for the periodic feature amount on a frame-by-frame basis, and a side information generating step of encoding the periodic feature amount obtained at the periodic feature amount determination step to obtain side information. In the periodic feature amount determination step, the periodic feature amount is determined from a set S made up of Y candidates (where Y<Z) among Z candidates for the periodic feature amount representable with the side information, the Y candidates including $Z_2$ candidates (where $Z_2$<Z) selected without depending on a candidate subjected to the periodic feature amount determination step in a previous frame a predetermined number of frames before the current frame and including a candidate subjected to the periodic feature amount determination step in the previous frame the predetermined number of frames before the current frame.

The periodic feature amount determination step may further include an adding step of adding to the set S a value adjacent to a candidate subjected to the periodic feature amount determination step in a previous frame the predetermined number of frames before the current frame and/or a value having a predetermined difference from the candidate.

A configuration is also possible where the greater an indicator indicating the degree of stationarity of the audio signal in the current frame, the greater the proportion of candidates subjected to the periodic feature amount determination step in the previous frame the predetermined number of frames before the current frame to the set S is.

A configuration is also possible where when the indicator indicating the degree of stationarity of the audio signal in the current frame is smaller than a predetermined threshold, only the $Z_2$ candidates are included in the set S.

The indicator indicating the degree of stationarity of the audio signal in the current frame increases when at least one of the conditions is satisfied.

(a-1) A "prediction gain of the audio signal in the current frame" increases, (a-2) an "estimated prediction gain of the audio signal in the current frame" increases, (b-1) the difference between a "prediction gain of the audio signal in the frame immediately preceding the current frame" and the "prediction gain of the audio signal in the current frame" decreases, (b-2) the difference between an "estimated prediction gain in the immediately preceding frame" and the "estimated prediction gain in the current frame" decreases, (c-1) the "sum of amplitudes of samples of the audio signal included in the current frame" increases, (c-2) the "sum of amplitudes of samples included in a sample string obtained by transforming a sample string of the audio signal included in the current frame into a frequency domain" increases, (d-1) the difference between the "sum of amplitudes of samples of the audio signal included in the immediately preceding frame" and the "sum of amplitudes of samples of the audio signal included in the current frame" decreases, (d-2) the difference between the "sum of amplitudes of samples included in a sample string obtained by transforming a sample string of the audio signal included in the immediately preceding frame into a frequency domain" and the "sum of amplitudes of samples included in a sample string obtained by transforming a sample string of the audio signal included in the current frame into a frequency domain" decreases, (e-1) "power of the audio signal in the current frame" increases, (e-2) "power of a sample string obtained by transforming a sample string of the audio signal in the current frame into a frequency domain" increases, (f-1) the difference between "power of the audio signal in the immediately preceding frame" and "power of the audio signal in the current frame" decreases, and (f-2) the difference between "power of a sample string obtained by transforming a sample string of the audio signal in the immediately preceding frame into a frequency domain" and "power of a sample string obtained by transforming a sample string of the audio signal in the current frame into a frequency domain" decreases.

Effects of the Invention

According to the present invention, at least some of the samples included in a sample string in a frequency domain that are derived from an audio signal, for example, are rearranged so that one or a plurality of successive samples including a sample corresponding to a periodicity or a fundamental frequency of an audio signal and one or a plurality of successive samples including samples corresponding to integer multiples of the periodicity or fundamental frequency of the audio signal are clustered. This processing can be performed with a small amount of computation of rearranging samples having equal or nearly equal indicators that reflect the magnitude of samples are gathered together in a cluster and thus the efficiency of coding is improved and quantization distortion is reduced. Furthermore, a periodic feature amount of the current frame or the interval can be efficiently determined since a candidate for the periodic feature amount or the interval that has been considered in a previous frame is taken into consideration on the basis of the nature of the audio signal in a period where the audio signal is in a stationary state.

DETAILED DESCRIPTION OF THE EMBODIMENTS

Figure 1:
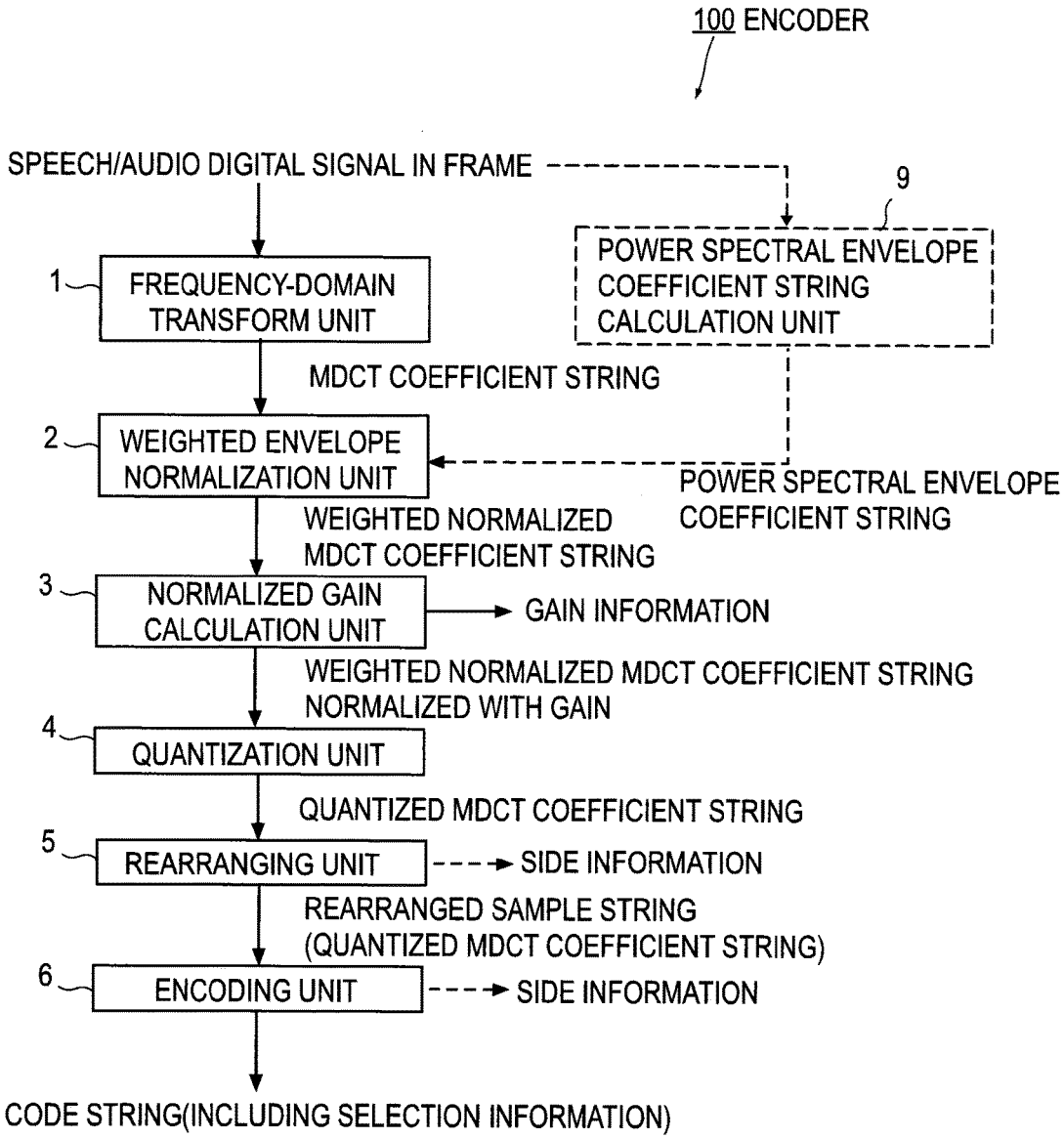
FIG. 1 is a diagram illustrating an exemplary functional configuration of an embodiment of an encoder.
Figure 2:
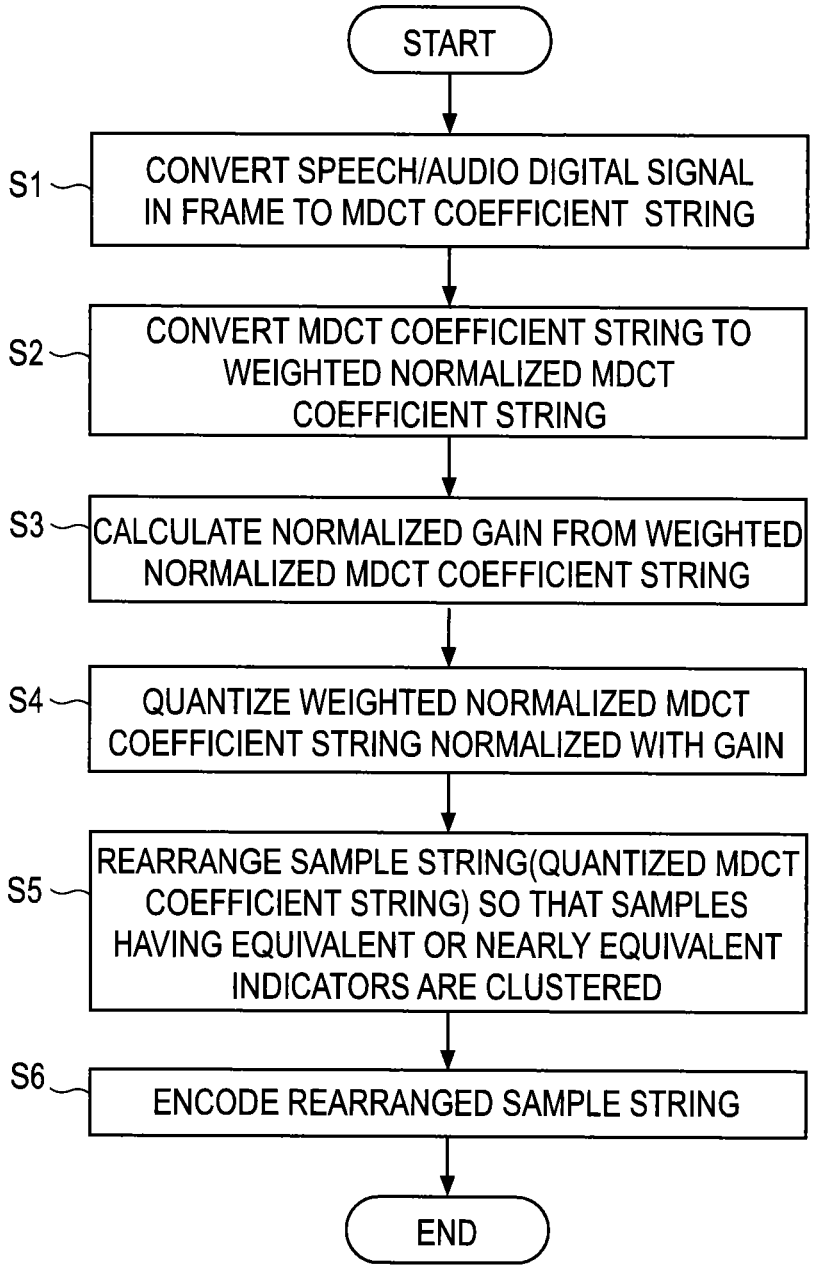
FIG. 2 is a diagram illustrating a process procedure of an embodiment of an encoding method.

Embodiments of the present invention will be described with reference to drawings. Same elements are given same reference numerals and repeated description of those elements will be omitted.

One of the features of the present invention is an improvement of encoding to reduce quantization distortion by rearranging samples based on a feature of frequency-domain samples and to reduce the code amount by using variable-length coding in a framework of quantization of frequency-domain sample strings derived from an audio signal in a given time period. The given time period will be hereinafter referred to as a frame. Encoding can be improved by rearranging the samples in a frame in which a fundamental periodicity, for example, is relatively obvious according to the periodicity to gather samples having great amplitudes together in a cluster. Examples of samples in a frequency domain that are derived from an audio signal include DFT coefficient strings and MDCT coefficient strings obtained by transforming a speech/audio digital signal in frames in a time domain into a frequency domain, and coefficient strings obtained by applying normalization, weighting and quantization to those coefficient strings. Embodiments of the present invention will be described below by taking MDCT coefficients strings as an example.

[Embodiments]

Encoding Process

An encoding process will be described first with reference to FIGS. 1 to 4. The encoding process of the present invention is performed by an encoder 100 in FIG. 1 which includes a frequency-domain transform unit 1, a weighted envelope normalization unit 2, a normalized gain calculation unit 3, a quantization unit 4, a rearranging unit 5, and an encoding unit 6, or by an encoder 100*a* in FIG. 10 which includes a frequency-domain transform unit 1, weighted envelope normalization unit 2, a normalized gain calculation unit 3, a quantization unit 4, a rearranging unit 5, an encoding unit 6, an interval determination unit 7, and a side information generating unit 8. However, the encoder 100 or 100*a* does not necessarily need to include the frequency-domain transform unit 1, the weighted envelope normalization unit 2, the normalized gain calculation unit 3, and the quantization unit 4. For example, the encoder 100 may be made up of a rearranging unit 5 and encoding unit 6; the encoder 100*a* may be made up of the rearranging unit 5, the encoding unit 6, the interval determination unit 7, and the side information generating unit 8. While in the encoder 100*a* illustrated in FIG. 10, the interval determination unit 7 includes the rearranging unit 5, the encoding unit 6 and the side information generating unit 8, the encoder is not limited to the configuration.

Frequency-Domain Transform Unit 1

First, the frequency-domain transform unit 1 transforms a speech/audio digital signal to an MDCT coefficients string at N points in a frequency domain on a frame-by-frame basis (step S1).

In general, the encoding side quantizes MDCT coefficient strings, encodes the quantized MDCT coefficient strings, and transmits the resulting code strings to the decoding side; the decoding side can reconstruct the quantized MDCT coefficient strings from the code strings and can further reconstruct a time-domain speech/audio digital signal by inverse MDCT transform. The amplitude of MDCT coefficients has approximately the same amplitude envelope (power spectral envelope) as the power spectrum of ordinary DFT. Accordingly, information assignment that is proportional to the logarithm value of the amplitude envelope can uniformly disperse quantization distortion (quantization error) of MDCT coefficients in all frequency bands, reduce the whole quantization distortion, and compress information. Note that the power spectral envelope can be efficiently estimated by using a linear predictive coefficient obtained by linear prediction analysis. Methods for controlling quantization error include a method of adaptively assigning quantization bits of MDCT coefficients (smoothing the amplitude and then adjusting the step-size of quantization) and a method of adaptively assigning a weight by weighted vector quantization to determine codes. It should be noted that while one example of a quantization method performed in an embodiment of the present invention will be described herein, the present invention is not limited to the quantization method described.

Weighted Envelope Normalization Unit 2

The weighted envelope normalization unit 2 normalizes the coefficients in an input MDCT coefficient string by using a power spectral envelope coefficient string of a speech/audio digital signal estimated using a linear predictive coefficient obtained by linear prediction analysis of the speech/audio digital signal in a frame, and outputs a weighted normalized MDCT coefficient string (step S2). Here, in order to achieve quantization that auditorily minimizes distortion, the weighted envelope normalization unit 2 uses a weighted power spectral envelope coefficient string obtained by moderating power spectral envelope to normalize the coefficients in the MDCT coefficient strings on a frame-by-frame basis. As a result, the weighted normalized MDCT coefficient string does not have a steep slope of amplitude or large variations in amplitude as compared with the input MDCT coefficient string but has variations in magnitude similar to those of the power spectral envelope coefficient string of the speech/audio digital signal, that is, the weighted normalized MDCT coefficient string has somewhat greater amplitudes in a region of coefficients corresponding to low frequencies and has a fine structure due to a pitch period.

[Example of Weighted Envelope Normalization Process]

Coefficients W(1), . . . , W(N) of a power spectral envelope coefficient string that correspond to the coefficients X(1), . . . , X(N) of an MDCT coefficient string at N points can be obtained by transforming linear predictive coefficients to a frequency domain. For example, according to a p-order autoregressive process, which is an all-pole model, a time signal x(t) at a time t can be expressed by equation (1) with past values x(t−1), . . . , x(t−p) of the time signal itself at the past p time points, predictive residuals e(t) and linear predictive coefficients $\alpha_1, \ldots, \alpha_P$. Then, the coefficients W(n) [1≤n≤N] of the power spectral envelope coefficient string can be expressed by equation (2), where exp(·) is an exponential function with a base of Napier's constant, j is an imaginary unit, and $\sigma^2$ is predictive residual energy.

$$x(t) + \alpha_1 x(t-1) + \ldots + \alpha_p x(t-p) = e(t) \tag{1}$$

$$W(n) = \frac{\sigma^2}{2\pi} \frac{1}{|1 + \alpha_1 \exp(-jn) + \alpha_2 \exp(-2jn) + \ldots + \alpha_p \exp(-pjn)^2} \tag{2}$$

The linear predictive coefficients may be obtained by liner predictive analysis by the weighted envelope normalization unit 2 of a speech/audio digital signal input in the frequency domain transform unit 1 or may be obtained by linear predictive analysis of a speech/audio digital signal by other means, not depicted, in the encoder 100 or 100*a*. In that case, the weighted envelope normalization unit 2 obtains the coefficients W(1), . . . , W(N) in the power spectral envelope coefficient string by using a linear predictive coefficient. If the coefficients W(1), . . . , W(N) in the power spectral envelope coefficient string have been already obtained with other means (the power spectral envelope coefficient string calculation unit 9) in the encoder 100 or 100*a*, the weighted envelope normalization unit 2 can use the coefficients W(1), . . . , W(N) in the power spectral envelope coefficient string. Note that since a decoder 200, which will be described later, needs to obtain the same values obtained in the encoder 100 or 100*a*, quantized linear predictive coefficients and/or power spectral envelope coefficient strings are used. Hereinafter, the term "linear predictive coefficient" or "power spectral envelope coefficient string" means a quantized linear predictive coefficient or a quantized power spectral envelope coefficient string unless otherwise stated. The linear predictive coefficients are encoded using a conventional encoding technique and predictive coefficient codes are then transmitted to the decoding side. The conventional encoding technique may be an encoding technique that provides codes corresponding to liner predictive coefficients themselves as predictive coefficients codes, an encoding technique that converts linear predictive coefficients to LSP parameters and provides codes corresponding to the LSP parameters as predictive coefficient codes, or an encoding technique that converts liner predictive coefficients to PARCOR coefficients and provides codes corresponding to the PARCOR coefficients as predictive coefficient codes, for example. If power spectral envelope coefficients strings are obtained with other means provided in the encoder 100 or 100*a*, other means in the encoder 100 or 100*a* encodes the linear predictive coefficients by a conventional encoding technique and transmits predictive coefficient codes to the decoding side.

While two examples of a weighted envelope normalization process will be given here, the present invention is not limited to the examples.

Example 1

The weighted envelope normalization unit 2 divides the coefficients X(1), . . . , X(N) in an MDCT coefficient string by modification values $W_\gamma$(1), . . . , $W_\gamma$(N) of the coefficients in a power spectral envelope coefficient string that correspond to the coefficients to obtain the coefficients X(1)/$W_\gamma$(1), . . . , X(N)/$W_\gamma$(N) in a weighted normalized MDCT coefficient string. The modification values $W_\gamma(n)$ [$1 \le n \le N$] are given by equation (3), where γ is a positive constant less than or equal to 1 and moderates power spectrum coefficients.

$$W_\gamma(n)\frac{\sigma^2}{2\pi\left(1+\sum_{i=1}^{p}\alpha_i\gamma^i\exp(-\boldsymbol{i}\boldsymbol{j}n)\right)^2} \tag{3}$$

Example 2

The weighted envelope normalization unit 2 divides the coefficients X(1), . . . , X(N) in an MDCT coefficient string by raised values W(1)$^\beta$, . . . , W(N)$^\beta$, which are obtained by raising the coefficients in a power spectral envelope coefficient string that correspond to the coefficients X(1), . . . , X(N) to the β-th power ($0<\beta<1$), to obtain the coefficients X(1)/W(1)$^\beta$, . . . , X(N)/W(N)$^\beta$ in a weighted normalized MDCT coefficient string.

As a result, a weighted normalized MDCT coefficient string in a frame is obtained. The weighted normalized MDCT coefficient string does not have a steep slope of amplitude or large variations in amplitude as compared with the input MDCT coefficient string but has variations in magnitude similar to those of the power spectral envelope of the input MDCT coefficient string, that is, the weighted normalized MDCT coefficient string has somewhat greater amplitudes in a region of coefficients corresponding to low frequencies and has a fine structure due to a pitch period.

Note that the inverse process of the weighted envelope normalization process, that is, the process for reconstructing the MDCT coefficient string from the weighted normalized MDCT coefficient string, is performed at the decoding side, settings for the method for calculating weighted power spectral envelope coefficient strings from power spectral envelope coefficient strings need to be common between the encoding and decoding sides.

Normalized Gain Calculation Unit 3

Then, the normalized gain calculation unit 3 determines a quantization step-size by using the sum of amplitude values or energy value over all frequencies so that the coefficients in the weighted normalized MDCT coefficient string in each frame can be quantized by a given total number of bits, and obtains a coefficient (hereinafter referred to as gain) by which the coefficients in the weighted normalized MDCT coefficient string is divided so that the determined quantization step-size is provided (step S3). Information representing the gain is transmitted to the decoding side as gain information. The normalized gain calculation unit 3 normalizes (divides) the coefficients in the weighted normalized MDCT coefficient string in each frame by the gain.

Quantization Unit 4

Then, the quantization unit 4 uses the quantization step-size determined in the process at step S3 to quantize the coefficients in the weighted normalized MDCT coefficient string normalized with the gain on a frame-by-frame basis (step S4).

Rearranging Unit 5

The quantized MDCT coefficient string in each frame obtained by the process at step S4 is input in the rearranging unit 5, which is the subject part of the present embodiment. The input to the rearranging unit 5 is not limited to coefficient strings obtained through the processes at steps S1 to S4. For example, the input may be a coefficient string that is not normalized by the weighted envelope normalization unit 2 or a coefficient string that is not quantized by the quantization unit 4. In order to provide a clear understanding of this, an input into the rearranging unit 5 will be hereinafter referred to as a "frequency-domain sample string" or simply referred to as a "sample string". In this embodiment, the quantized MDCT coefficient string obtained in the process at step S4 is equivalent to the "frequency-domain sample string" and, in this case, the samples making up the frequency-domain sample string are equivalent to the coefficients in the quantized MDCT coefficient string.

The rearranging unit 5 rearranges, on a frame-by-frame basis, at least some of the samples included in the frequency-domain sample string so that (1) all of the samples in the frequency-domain sample string are included and (2) samples that have equal or nearly equal indicators that reflect the magnitude of the samples are gathered together in a cluster, and outputs the rearranged sample string (step S5).

Here, examples of the "indicators that reflects the magnitude of the samples" include, but not limited to, the absolute values of amplitudes of the samples or power (square values) of the samples.

[Details of Rearranging Process]

An example of the rearranging process will be described. For example, the rearranging unit 5 rearranges at least some of the samples included in a sample string so that (1) all of the samples in the sample string are included and (2) all or some of one or a plurality of successive samples in the sample string, including a sample that corresponds to a periodicity or a fundamental frequency of the audio signal and one or a plurality of successive samples in the sample string, including a sample that corresponds to an integer multiple of the periodicity or the fundamental frequency of the audio signal are gathered together in a cluster, and outputs the rearranged sample string. That is, at least some of the samples included in the input sample string are rearranged so that one or a plurality of successive samples including a sample corresponding to the periodicity or fundamental frequency of the audio signal and one or a plurality of successive samples including a sample corresponding to an integer multiple of the periodicity or fundamental frequency of the audio signal are gathered together in a cluster.

This is based on a distinctive characteristic of audio signals, especially speech and music, that the absolute values of amplitudes of samples and power of samples that correspond to the fundamental frequency and harmonics (a frequency that is an integer multiple of the fundamental frequency) and samples near those samples are greater than the absolute values of amplitudes of samples and power of samples that correspond to frequency bands other than the fundamental frequency and harmonics. Audios signals also have a characteristic that since a periodic feature amount (for example a pitch period) of an audio signal that is extracted from an audio signal such as speech and music is equivalent to the fundamental frequency, the absolute values and the amplitudes of samples and power of samples that by jmax. A set of samples selected according to n is referred to as a sample group. The upper bound N may be equal to jmax. However, N may be smaller than jmax in order to gather samples having great indicators together in a cluster at the lower frequency side to improve the efficiency of encoding as will be described later, because indicators of samples in a high frequency band of an audio signal such as speech and music are typically sufficiently small. For example, N may be about a half the value of jmax. Let nmax denote the maximum value of n that is determined based on the upper bound N, then samples corresponding to frequencies in the range from the lowest frequency to a first predetermined frequency nmax*T+1 among the samples in an input sample string are the samples to be rearranged. Here, the symbol * represents multiplication.

The rearranging unit 5 arranges the selected samples F(j) in order from the beginning of the sample string while maintaining the original order of the identification numbers j to generate a sample string A. For example, if n represents an integer in the range from 1 to 5, the rearranging unit 5 arranges a first sample group F(T−1), F(T) and F(T+1), a second sample group F(2T−1), F(2T) and F(2T+1), a third sample group F(3T−1), F(3T) and F(3T+1), a fourth sample group F(4T−1), F(4) and F(4T+1), and a fifth sample group F(5T−1), F(5T) and F(5T+1) in order from the beginning of the sample string. That is, 15 samples F(T−1), F(T), F(T+1), F(2T−1), F(2T), F(2T+1), F(3T−1), F(3T), F(3T+1), F(4T−1), F(4T), F(4T+1), F(5T−1), F(5T) and F(5T+1) are arranged in this order from the beginning of the sample string and the 15 samples make up sample string A.

The rearranging unit 5 further arranges samples F(j) that have not correspond to the periodic feature amount (for example the pitch period) of the audio signal and integer multiples and the absolute values of amplitudes of samples and power of samples near those samples are greater than the absolute values of amplitudes of samples and power samples that correspond to frequency bands other than the periodic feature amount and integer multiples of the periodic feature amount.

One or a plurality of successive samples including a sample corresponding to the periodicity or fundamental frequency of the audio signal, and one or a plurality of successive samples including a sample corresponding to an integer multiple of the periodicity or fundamental frequency of the audio signal are gathered together in one cluster at the low frequency side. The interval between a sample corresponding to the periodicity or fundamental frequency of an audio signal and a sample corresponding to an integer multiple of the periodicity or fundamental frequency of the audio signal (hereinafter simply referred to as the interval) is hereinafter denoted by T.

In a specific example, the rearranging unit 5 selects three samples, namely a sample F(nT) corresponding to an integer multiple of the interval T, the sample preceding the sample F(nT) and the sample succeeding the sample F(nT), F(nT−1), F(nT) and F(nT+1), from an input sample string. F(j) is a sample corresponding to an identification number j representing a sample index corresponding to a frequency. Here, n is an integer in the range from 1 to a value such that nT+1 does not exceed a predetermined upper bound N of samples to be rearranged. n=1 corresponds to a fundamental frequency and n>1 corresponds to a harmonic. The maximum value of the identification number j representing a sample index corresponding to a frequency is denoted been selected in order from the end of sample string A while maintaining the original order of the identification numbers j. The samples F(j) that have not been selected are located between the sample groups that make up sample string A. A cluster of such successive samples is referred to as a sample set. That is, in the example described above, a first sample set F(1), F(T−2), a second sample set F(T+2), . . . , F(2T−2), a third sample set F(2T+2), . . . , F(3T−2), a fourth sample set F(3T+2), . . . , F(4T−2), a fifth sample set F(4T+2), . . . , F(5T−2), and a sixth sample set F(5T+2), . . . , F(jmax) are arranged in order from the end of sample string A and these samples make up sample string B.

Figure 3:
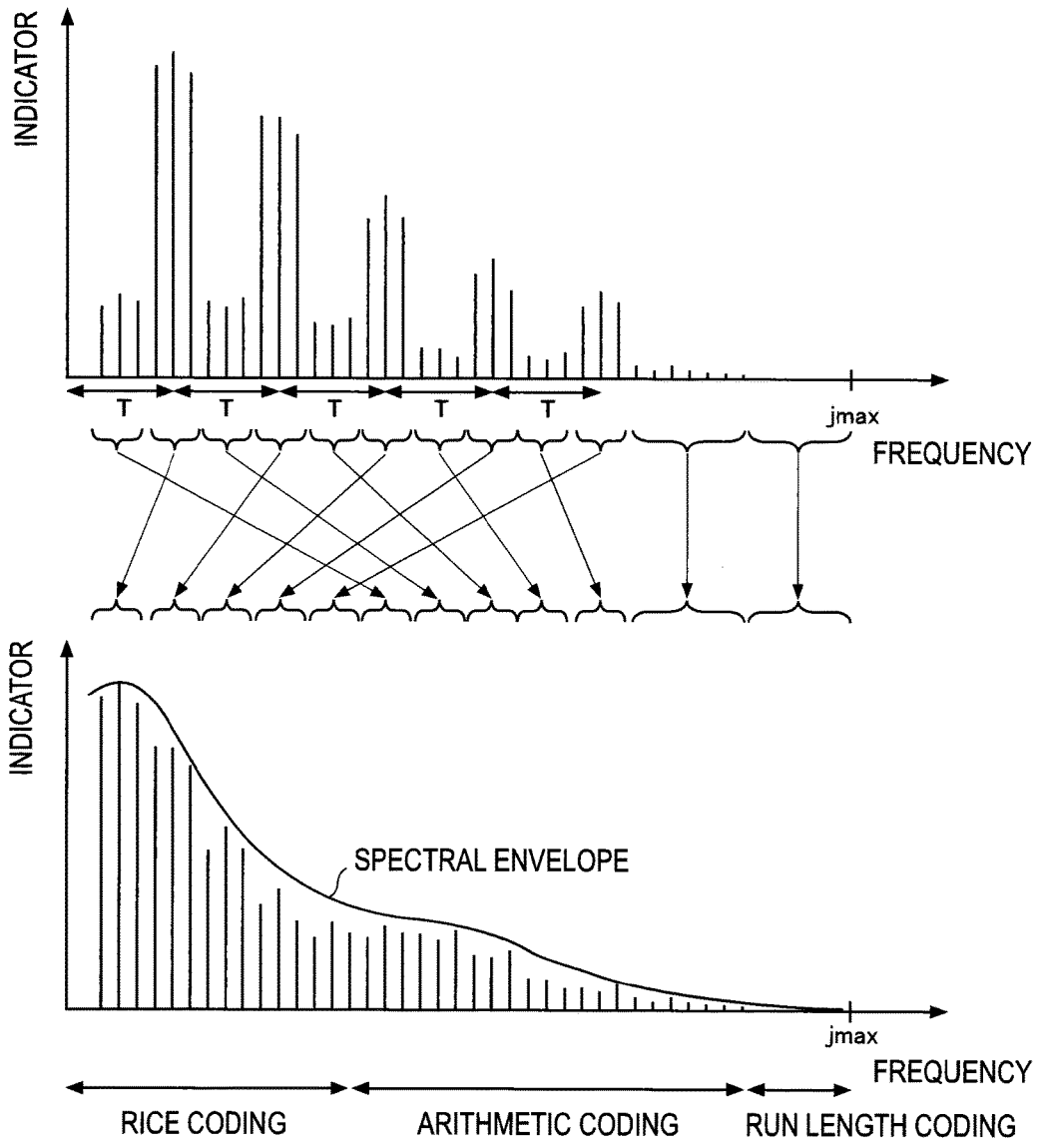
FIG. 3 is a conceptual diagram illustrating an example of rearranging of samples included in a sample string.
Figure 4:
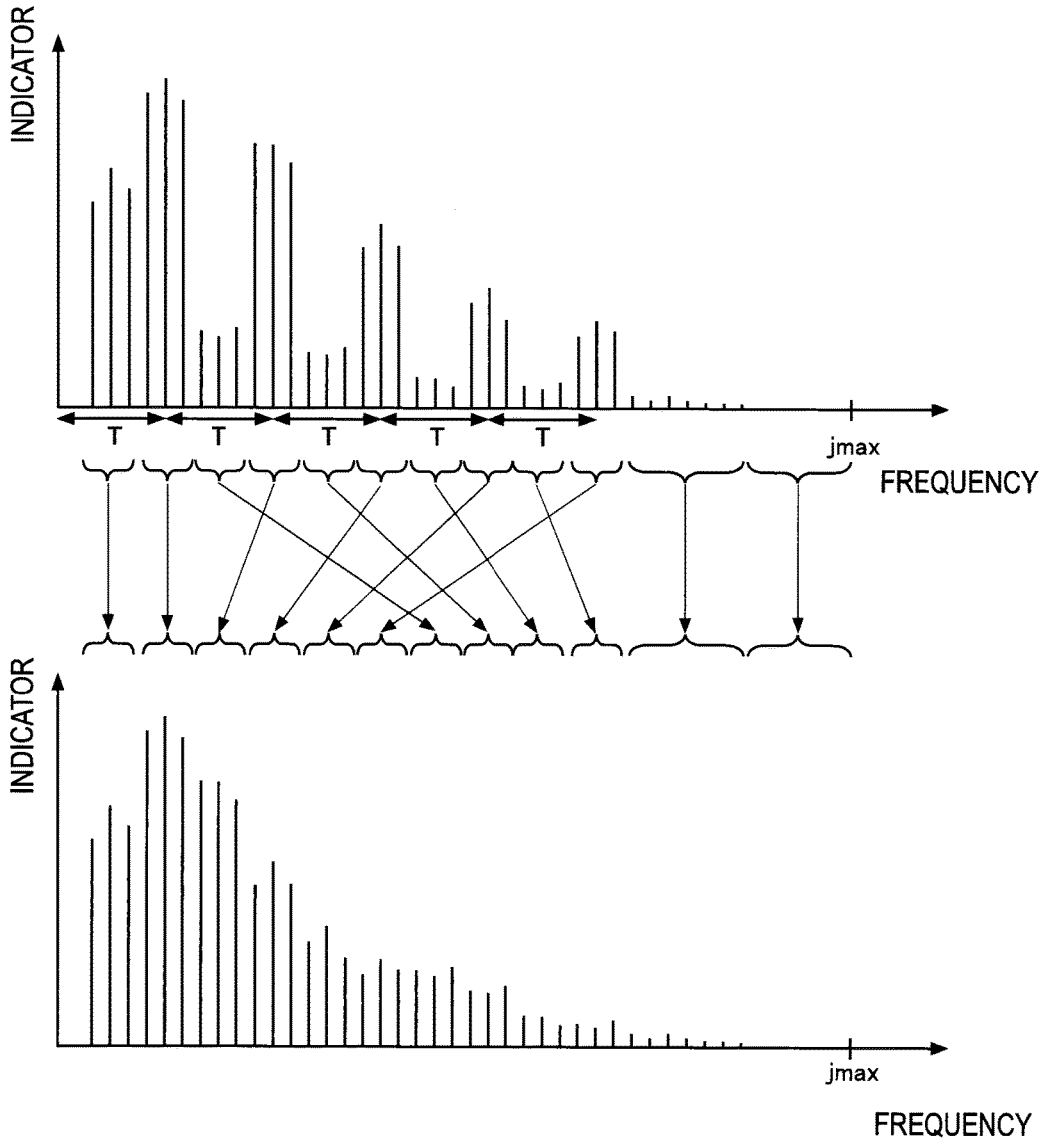
FIG. 4 is a conceptual diagram illustrating an example or rearranging of samples included in a sample string.

In short, an input sample string F(j) (1≤j≤jmax) in this example is rearranged as F(T−1), F(T), F(T+1), F(2T−1), F(2T), F(2T+1), F(3T−1), F(3T), F(3T+1), F(4T−1), F(4T), F(4T+1), F(5T−1), F(5T), F(5T+1), F(1), F(T−2), F(T+2), . . . , F(2T−2), F(2T+2), . . . , F(3T−2), F(3T+2), . . . , F(4T−2), F(4T+2), . . . , F(5T−2), F(5T+2), . . . , F(jmax) (see FIG. 3).

Note that in a low frequency band, samples other than samples corresponding to a periodicity or fundamental frequency of an audio signal and samples corresponding to integer multiples of them often have great amplitudes and power values. Therefore, samples in a range from the lowest frequency to a predetermined frequency f may be excluded from rearranging.

For example, if the predetermined frequency f is nT+α, original samples F(1), . . . , F(nT+α) are not rearranged but original samples F(nT+α+1) and the subsequent samples are rearranged, where α is preset to an integer greater than or equal to 0 and somewhat less than T (for example an integer less than T/2). Here, n may be an integer greater than or equal to 2. Alternatively, original P successive samples F(1), . . . , F(P) from a sample corresponding to the lowest frequency may be excluded from rearranging and original sample F(P+1) and the subsequent samples may be rearranged. In this case, the predetermined frequency f is P. A collection of samples to be rearranged are rearranged according to the rule described above. Note that if a first predetermined frequency has been set, the predetermined frequency f (a second predetermined frequency) is lower than the first predetermined frequency.

If original samples F(1), . . . , F(T+1), for example, are not rearranged and an original sample F(T+2) and the subsequent samples are to be rearranged, the input sample string F(j) ($1 \leq j \leq jmax$) will be rearranged as F(1), . . . , F(T+1), F(2T−1), F(2T), F(2T+1), F(3T−1), F(3T), F(3T+1), F(4T−1), F(4T), F(4T+1), F(5T−1), F(5T), F(5T+1), F(T+2), . . . , F(2T−2), F(2T+2), . . . , F(3T−2), F(3T+2), . . . , F(4T−2), F(4T+2), . . . , F(5T−2), F(5T+2), . . . , F(jmax) according to the rearranging rule described above (see FIG. 4). Note that while all of the samples included in the sample string in a frequency domain are depicted as having a value greater than or equal to 0 in FIGS. 3 and 4, they are so depicted in order to clearly show that samples that have greater amplitudes appear at the lower frequency side as a result of rearranging of the samples. Samples included in a sample string in the frequency domain can take positive or negative values or zero in some cases; the rearranging described above or rearranging described later can be performed for any of those cases.

Different upper bounds N or different first predetermined frequencies which determine the maximum value of identification numbers j to be rearranged may be set for different frames, rather than setting an upper bound N or first predetermined frequency that is common to all frames. In that case, information specifying an upper bound N or a first predetermined frequency for each frame may be transmitted to the decoding side. Furthermore, the number of sample groups to be rearranged may be specified instead of specifying the maximum value of identification numbers j to be rearranged. In that case, the number of sample groups may be set for each frame and information specifying the number of sample groups may be transmitted to the decoding side. Of course, the number of sample groups to be rearranged may be common to all frames. Different second predetermined frequencies f may be set for different frames, instead of setting a second predetermined value that is common to all frames. In that case, information specifying a second predetermined frequency for each frame may be transmitted to the decoding side.

The envelope of indicators of the samples in the sample string thus rearranged declines with increasing frequency when frequencies and the indicators of the samples are plotted as abscissa and ordinate, respectively. The reason is the fact that audio signal sample strings, especially speech and music signals sample strings in the frequency domain generally contain fewer high-frequency components. In other words, the rearranging unit 5 rearranges at least some of the samples contained in the input sample string so that the envelope of indicators of the samples declines with increasing frequency.

While the rearranging in this embodiment gathers one or a plurality of successive samples including a sample corresponding to the periodicity or fundamental frequency and one or a plurality of successive samples including a sample corresponding to an integer multiple of the periodicity or fundamental frequency together into one cluster at the low frequency side, rearranging may be performed that gathers one or a plurality of successive samples including a sample corresponding to the periodicity or fundamental frequency and one or a plurality of successive samples including samples corresponding to an integer multiple of the periodicity or fundamental frequency together into one cluster at the high frequency side. In that case, sample groups in sample string A are arranged in the reverse order, sample sets in sample string B are arranged in the reverse order, sample string B is placed at the low frequency side, sample string A follows sample string B. That is, the samples in the example described above are ordered in the following order from the low frequency side: the sixth sample set F(5T+2), . . . , F(jmax), the fifth sample set F(4T+2), . . . , F(5T−2), the fourth sample set F(3T+2), . . . , F(4T−2), the third sample set F(2T+2), . . . , F(3T−2), the second sample set F(T+2), . . . , F(2T−2), the first sample set F(1), . . . , F(T−2), the fifth sample group F(5T−1), F(5T), F(5T+1), the fourth sample group F(4T−1), F(4T), F(4T+1), the third sample group F(3T−1), F(3T), F(3T+1), the second sample group F(2T−1), F(2T), F(2T+1), and the first sample group F(T−1), F(T), F(T+1). The envelope of indicators of the samples in the sample string thus rearranged rises with increasing frequency when frequencies and the indicators of samples are plotted as abscissa and ordinate, respectively. In other words, the rearranging unit 5 rearranges at least some of the samples included in the input sample string so that the envelope of the samples rises with increasing frequency.

The interval T may be a fractional value (for example 5.0, 5.25, 5.5 or 5.75) instead of an integer. In that case, F(R(nT−1)), F(R(nT)), and F(R(nT+1)) are selected, where R(nT) represents a value nT rounded to an integer.

Encoding Unit 6

The encoding unit 6 encodes the rearranged input sample string and outputs the resulting code string (step S6). The encoding unit 6 changes variable-length encoding according to the localization of the amplitudes of samples included in the input rearranged sample string and encodes the sample string. That is, since samples having great amplitudes are gathered together in a cluster at the low (or high) frequency side in a frame by the rearranging, the encoding unit 6 performs variable-length encoding appropriate for the localization. If samples having equal or nearly equal amplitudes are gathered together in a cluster in each local region like the rearranged sample string, the average code amount can be reduced by, for example Rice encoding using different Rice parameters for different regions. An example will be described in which samples having great amplitudes are gathered together in a cluster at the low frequency side in a frame (the side closer to the beginning of the frame).

[Example of Encoding]

The encoding unit 6 applies Rice encoding (also called Golomb-Rice encoding) to each sample in a region where samples with indicators corresponding to great amplitudes are gathered together in a cluster.

In a region other than this region, the encoding unit 6 applies entropy coding (such as Huffman coding or arithmetic coding) to a plurality of samples as a unit. For applying Rice coding, a Rice parameter and a region to which Rice coding is applied may be fixed or a plurality of different combinations of region to which Rice coding is applied and Rice parameter may be provided so that one combination can be chosen from the combinations. When one of the plurality of combinations is chosen, the following variable-length codes (binary values enclosed in quotation marks " "), for example, can be used as selection information indicating the choice for Rice coding and the encoding unit 6 outputs a code string including the selection information indicating the choice.

"1": Rice coding is not applied.

"01": Rice coding is applied to the first 1/32 region of a string with Rice parameter 1.

"001": Rice coding is applied to the first 1/32 region of a string with Rice parameter 2.

"0001": Rice coding is applied to the first 1/16 region of a string with Rice parameter 1.

"00001": Rice coding is applied to the first 1/16 region of a string with Rice parameter 2.

"00000": Rice coding is applied to the first 1/32 region of a string with Rice parameter 3.

A method for choosing one of these alternatives may be to compare the code amounts of code strings corresponding to different alternatives for Rice coding that are obtained by encoding to choose an alternative with the smallest code amount.

When a region where samples having an amplitude of 0 occur in a long succession appears in a rearranged sample string, the average code amount can be reduced by run length coding, for example, of the number of the successive samples having an amplitude of 0. In such a case, the encoding unit 6 (1) applies Rice coding to each sample in the region where the samples having indicators corresponding to great amplitudes are gathered together in a cluster and, (2) in the regions other than that region, (a) applies encoding that outputs codes that represents the number of successive samples having an amplitude of 0 to a region where samples having an amplitude of 0 appear in succession, (b) applies entropy coding (such as Huffman coding or arithmetic coding) to a plurality of samples as a unit in the remaining regions. Again, a choice can be made among Rice coding alternatives described above. In this case, information indicating regions where run length coding has been applied needs to be sent to the decoding side. This information may be included in the code string, for example. Additionally, if a plurality of types of entropy coding methods are provided as alternatives, information identifying which of the types of coding has been chosen needs to be sent to the decoding side. The information may be included in the code string, for example.

[Methods for Determining Interval T]

Methods for determining the interval T will be described. In an example of simple method, Z candidates for the interval T, $T_1$, $T_2$, . . . , $T_Z$, are provided in advance, the rearranging unit 5 rearranges the samples included in a sample string by using each of the candidates $T_1$ (i=1, 2, . . . , Z), the encoding unit 6, which will be described later, obtains the code amount of a code string corresponding to the sample string obtained based on each of the candidates $T_1$ and chooses the candidate $T_1$ that provides the smallest code amount as the interval T. The encoding unit 6 outputs side information that identifies the rearranging of the samples included in the sample string, for example a code obtained by encoding the interval T.

To determine an appropriate interval T, it is desirable that Z be sufficiently large. However, if Z is sufficiently large, a significantly large amount of computation is required for computing the actual code amounts for all of the candidates, which can be problematic in terms of efficiency. From this point of view, in order to reduce the amount of computation, preliminary selection process may be applied to Z candidates to reduce the number of candidates to Y. The preliminary selection process here is a process for selecting candidates for the final selection process by approximating the code amount of (calculating an estimated code amount of) a code string corresponding to a rearranged sample string (depending on conditions, an original sample string that has not been rearranged) obtained based on each candidate or by obtaining an indicator reflecting the code amount of the code string or an indicator that relates to the code amount of the code string (here, the indicator differs from the "code amount"). The final selection process selects the interval T on the basis of the actual code amounts of the code string corresponding to the sample string. While various kinds of preliminary selection processes are possible, the code amount of a code string corresponding to a sample string is actually calculated for each of the Y candidates obtained by whatever the preliminary selection process and the candidate $T_j$ that yields the smallest code amount is selected as the interval T ($T_j \in S_Y$, where $S_Y$ is a set of Y candidates). Y needs to satisfy at least Y<Z. For the purpose of a significant reduction of the amount of computation, Y is preferably set to a value significantly smaller than Z, so that Y≤Z/2, for example, is satisfied. In general, the process for calculating the code amounts requires a huge amount of computation. Let A denote the amount of this computation. Assuming that the amount A of computation for preliminary selection process is about 1/10 of this amount of computation, that is, A/10, then the amount of computation required for calculating the code amounts for all of the Z candidates is ZA. On the other hand, the amount of computation required for performing the preliminary selection process applied to all of the Z candidates and then calculating the code amounts for Y candidates selected by the preliminary selection process is (ZA/10+YA). It will be appreciate that if Y<9Z/10, the method using the preliminary selection process requires a smaller amount of computation for determining the interval T.

The present invention also provides a method for determining the interval T with a less amount of computation. Prior to describing an embodiment of the method, the concept of determining the interval T with a small amount of computation will be described.

A periodic feature amount of an audio signal such as speech and music in general often gradually changes over a plurality of frames in a period where the audio signal is in a stationary state. Accordingly, by taking into consideration the interval $T_{t-1}$ determined in the frame $X_{t-1}$ immediately preceding a given frame $X_t$, the interval $T_t$ in the frame $X_t$ can be efficiently determined. However, the interval $T_{t-1}$ determined in frame $X_{t-1}$ is not necessarily an interval $T_t$ appropriate for frame $X_t$. Therefore, it is preferable that a candidate for the interval T used for determining the interval $T_{t-1}$ in the frame $X_{t-1}$ be included in the candidates for the interval T for determining the interval $T_t$ in the frame $X_t$, instead of taking into consideration only the interval $T_{t-1}$ determined in the frame $X_{t-1}$.

On the other hand, in a signal period over a plurality of frames where the audio signal is in a nonstationary state, it is difficult to expect continuity of a periodic feature amount of the audio signal across adjacent frames. Therefore, if determination as to whether or not a signal period across frames is a period where the signal is in a stationary state is not made by other means, not depicted, the strategy of "finding an interval $T_t$ in frame $X_t$ from among candidates for the interval T used for determining the interval $T_{t-1}$ in frame $X_{t-1}$" does not necessarily provide a preferable result. That is, in such a situation, it is desirable that the interval $T_t$ be allowed to be found from among candidates for the interval T in the frame $X_t$ that are not dependent on candidates for the interval T used for determining the interval $T_{t-1}$ in the frame $X_{t-1}$.

Figure 7:
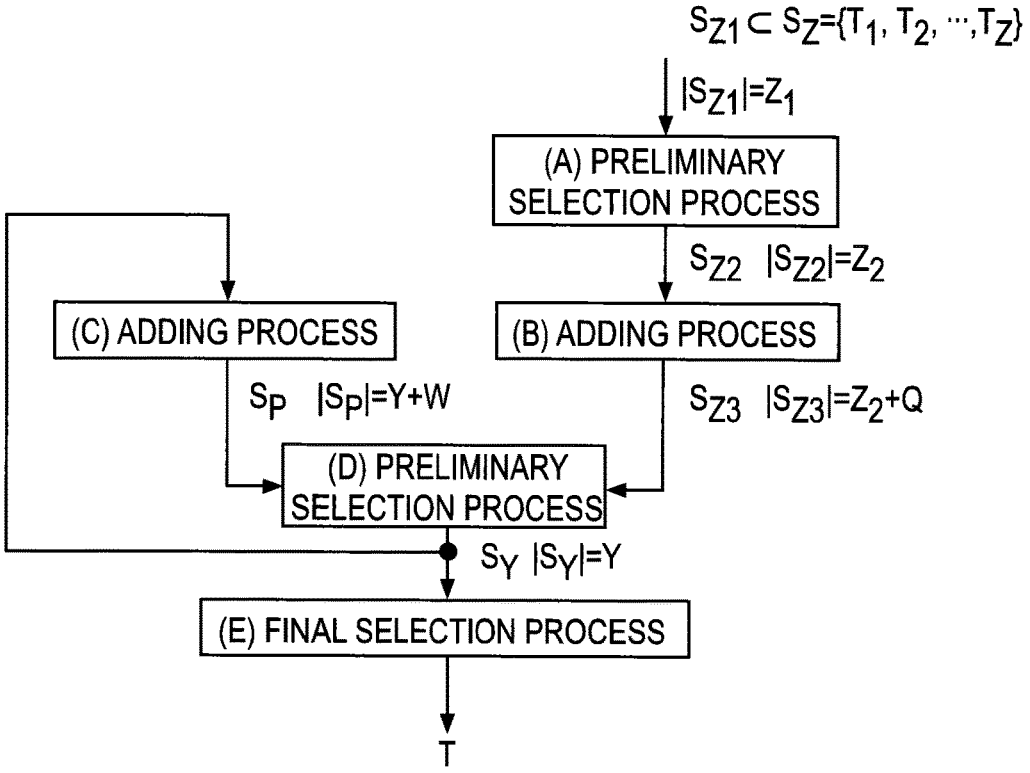
FIG. 7 is a diagram illustrating an example of a process function for determining an interval T.
Figure 8:
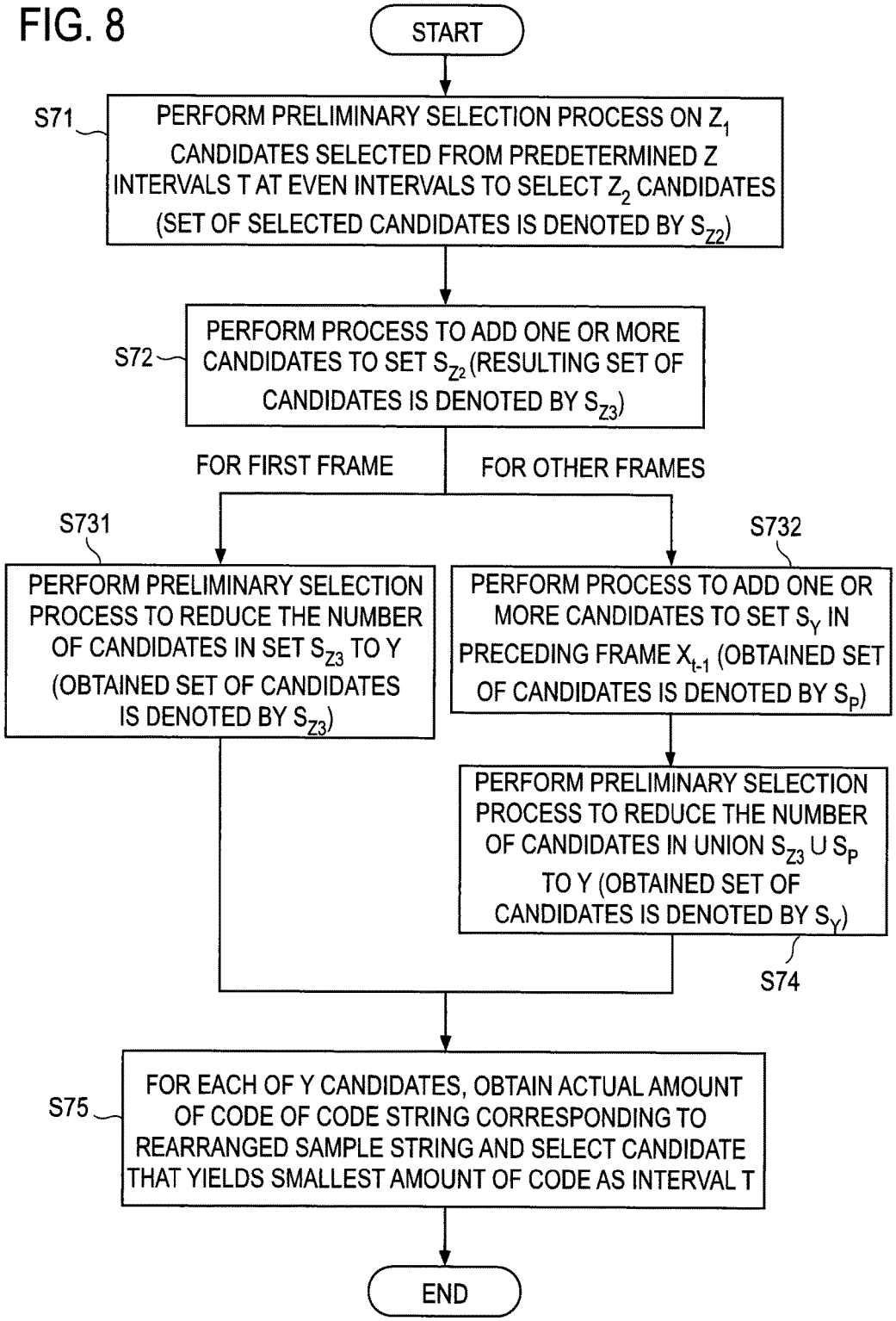
FIG. 8 is a diagram illustrating an example of a process procedure for determining an interval T.
Figure 10:
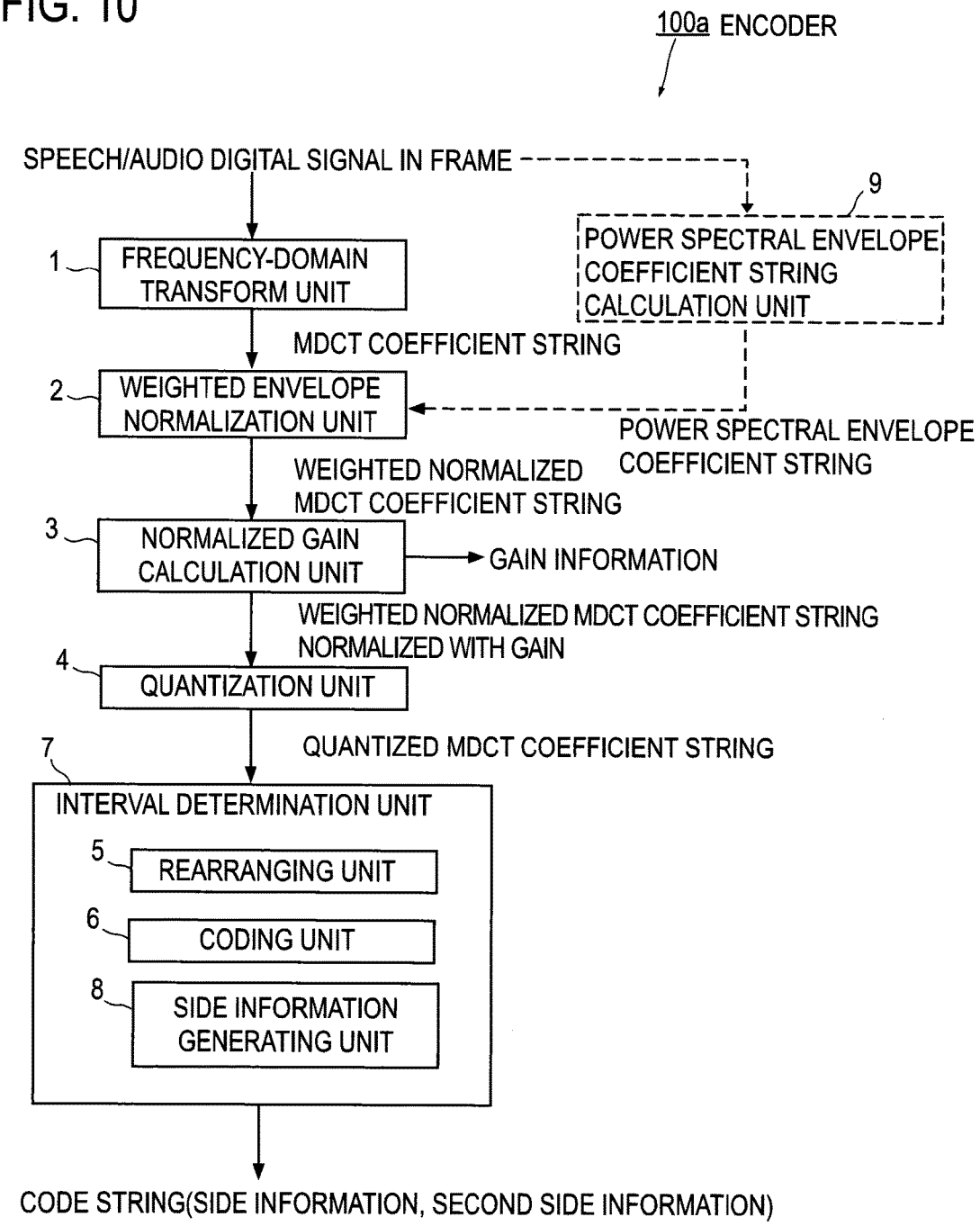
FIG. 10 is a diagram illustrating a modification of an embodiment of an encoder.

An embodiment based on the concept will be described in detail (see FIGS. 7 and 8). In the embodiment, an interval determination unit 7 is provided in an encoder 100*a* as depicted in FIG. 10 and a rearranging unit 5, an encoding unit 6 and a side information generating unit 8 are provided in the interval determination unit 7.

(A) Preliminary Selection Process (Step S71)

Candidates for the interval T that can be represented by side information identifying rearranging of the samples in a sample string are predetermined in association with a method of encoding the side information, which will be described later, such as fixed-length coding or variable-length coding. The interval determination unit 7 stores $Z_1$ candidates $T_1, T_2, \ldots, T_Z$ chosen in advance from Z predetermined different candidates for the interval T ($Z_1<Z$). The purpose of this is to reduce the number of candidates to be subjected to preliminary selection process. It is desirable that the candidates to be subjected to the preliminary selection process include as many intervals that are preferable as the interval T for the frame as possible among $T_1, T_2, \ldots, T_Z$. In reality, however, preferability is unknown before the preliminary selection process. Therefore, $Z_1$ candidates are chosen from the Z candidates $T_1, T_2, \ldots, T_Z$ at even intervals, for example, as the candidates to be subjected to preliminary selection process. For example, $Z_1$ candidates to be subjected to preliminary selection process may be chosen from the Z candidates $T_1, T_2, \ldots, T_Z$ in accordance with the policy of "choosing odd-position candidates from among Z candidates $T_1, T_2, \ldots, T_Z$ as candidates to be subjected to preliminary selection process" (where $Z_1=\mathrm{ceil}(Z/2)$ and ceil(·) is a ceiling function). The set of Z candidates is denoted by $S_Z$ ($S_Z=\{T_1, T_2, \ldots, T_Z\}$) and the set of $Z_1$ candidates is denoted by $S_{Z1}$.

The interval determination unit 7 performs the selection process described above on the $Z_1$ candidates to be subjected to preliminary selection process. The number of candidates reduced by this selection is denoted by $Z_2$. Various kinds of the preliminary selection processes are possible as stated above. A method based on an indicator relating to the code amounts of a code string corresponding to a rearranged sample string may be to choose $Z_2$ candidates on the basis of the degree of concentration of indicators of samples on a low frequency region or on the basis of the number of successive samples that have an amplitude of zero along the frequency axis from the highest frequency toward the low frequency side.

Specifically, if the value of $Z_2$ is not preset, the following preliminary selection process is performed. The interval determination unit 7 performs the rearranging described above on a sample string on the basis of each candidate for each of candidates, calculates the sum of the absolute values of the amplitudes of the samples contained in the first ¼ region, for example, from the low frequency side of the rearranged sample string as an indicator relating to the code amounts of a code string corresponding to the sample string, and chooses that candidate if the sum is greater than a predetermined threshold. Alternatively, the interval determination unit 7 rearranges the sample string as described above on the basis of each candidate, obtains the number of successive samples having an amplitude of zero from the highest frequency toward the low frequency side as an indicator relating to the code amount of a code string corresponding to the sample string, and chooses that candidate if the number of successive samples is greater than a predetermined threshold. The rearranging is performed by the rearranging unit 5. Here, the number of chosen candidates is $Z_2$ and the value of $Z_2$ can vary from frame to frame.

If the value of $Z_2$ is preset, the following preliminary selection process is performed. The interval determination unit 7 performs the rearranging described above on a sample string on the basis of each candidate for each of $Z_1$ candidates, calculates the sum of the absolute values of the amplitudes of the samples contained in the first ¼ region, for example, from the low frequency side of the string of the rearranged samples as an indicator relating to the code amount of a code string corresponding to the sample string, and chooses $Z_2$ candidates that yield the $Z_2$ largest sums. Alternatively, the interval determination unit 7 performs the rearranging described above on the sample string on the basis of each candidate for each of $Z_1$ candidates, obtains the number of successive samples having an amplitude of zero in the rearranged sample string from the highest frequency toward the lower frequency side as an indicator relating to the code amounts of a code string corresponding to the sample string, and chooses $Z_2$ candidates that yield the $Z_2$ largest numbers of successive samples. The rearranging of the sample string is performed by the rearranging unit 5. The value of $Z_2$ is equal in every frame. Of course, at least the relation $Z>Z_1>Z_2$ is satisfied. The set of $Z_2$ candidates is denoted by $S_{Z2}$.

(B) Adding Process (Step S72)

Then the interval determination unit 7 performs a process for adding one or more candidates to the set $S_{Z2}$ of candidates obtained by the preliminary selection process in (A). The purpose of this adding process is to prevent the value of $Z_2$ from becoming too small to find the interval T in the final selection described above when the value of $Z_2$ can vary from frame to frame, or to increase the possibility of choosing an appropriate interval T in the final selection as much as possible even though $Z_2$ becomes a relatively large. Since the purpose of the method for determining the interval T in the present invention is to reduce the amount of computation as compared with the amount of computation of conventional techniques, the number Q of added candidates needs to satisfy $Z_2+Q<Z$, where the number $|S_{Z2}|$ of the elements (candidates) of the set $S_{Z2}$ is $|S_{Z2}|=Z_2$. A more preferable condition is that Q satisfies $Z_2+Q<Z_1$. Candidates added may be the candidates $T_{k-1}$ and $T_{k+1}$ preceding and succeeding a candidate $T_k$ included in the set $S_{Z2}$, for example, where $T_{k-1}, T_{k+1} \in S_Z$ (here, the candidates "preceding and succeeding" the candidate $T_k$ are the candidates preceding and succeeding the $T_k$ in the order $T_1<T_2<\ldots<T_Z$ based on the magnitude of value introduced in the set $S_Z=\{T_1, T_2, \ldots, T_Z\}$). The reason is that there is the possibility that the candidates $T_{k-1}$ and $T_{k+1}$ are not included in the $Z_1$ candidates to be subjected to preliminary selection process. However, if the candidates $T_{k-1}, T_{k+1} \in S_{Z1}$ and the candidates $T_{k-1}$ and $T_{k+1}$ are not included in the set $S_{Z2}$, the candidates $T_{k-1}$ and $T_{k+1}$ do not necessarily need to be added. It is only needed to choose candidates to be added from the set $S_Z$. For example, for a candidate $T_k$ included in the set $S_{Z2}$, $T_k-\alpha$ (where $T_k-\alpha \in S_Z$) and/or $T_k+\beta$ (where $T_k+\beta \in S_Z$) may be added as a new candidate. Here, α and β are predetermined positive real numbers, for example, and α may be equal to β. If $T_k-\alpha$ and/or $T_k+\beta$ overlaps another candidate included in the set $S_{Z2}$, $T_k-\alpha$ and/or $T_k+\beta$ is not added (because there is no point in adding them). A set of $Z_2+Q$ candidates is denoted by $S_{Z3}$. Then, a process in (D1) or (D2) is performed.

(D) Preliminary Selection Process (Step S73)

(D1—Step S731) If a frame for which the interval T is to be determined is the temporally first frame, the interval determination unit 7 performs the preliminary selection process described above for $Z_2$+Q candidates included in the set $S_{Z3}$. The number of candidates reduced by the preliminary selection process is denoted by Y, which satisfies $Y<Z_2+Q$.

Various kinds of preliminary selection processes are possible as stated earlier. For example, the same process as the preliminary selection in (A) may be performed (the number of output candidates differs, that is, Y # $Z_2$). It should be noted that in this case the value of Y can vary from frame to frame. In a preliminary selection process different from the preliminary selection process in (A) described above, the rearranging described above is performed on the sample string for each of the $Z_2$+Q candidates included in the set $S_{Z3}$, for example, and a predetermined approximation equation for approximating the code amount of a code string obtained by encoding the rearranged sample string is used to obtain an approximate code amount (an estimated code amount). The rearranging of the sample string is performed by the rearranging unit 5. For candidates for which a rearranged sample string has been obtained in the preliminary selection process in (A), the rearranged sample string obtained in the preliminary selection process in (A) may be used. In that case, if the value of Y is not preset, candidates that yield approximate amounts of code less than or equal to a predetermined threshold may be chosen as the candidates to be subjected to an (E) code amount calculation process, which will be describe later (in this case, the number of chosen candidates is Y); if the value of Y is preset, Y candidates that yield smallest approximate code amounts may be chosen as the candidates to be subjected to the (E) final selection process, which will be described later. The Y candidates are stored in a memory and are used in the process in (C) or (D2), which will be described later, for determining the interval T in the temporally second frame After the process in (D1), the final selection process in (E) is performed.

If the same preliminary selection process as the preliminary selection process in (A) is performed in (D1) and candidates are chosen by comparison between an indicator relating to the code amount of a code string obtained by encoding of the rearranged sample string in the preliminary selection process in (A) and a threshold, the candidates chosen in the preliminary selection process in (A) are always chosen in the preliminary selection process in (D1). Therefore, the process of comparing the indicator with the threshold to choose candidates need to be performed only for the candidates added in the adding process (B), and the candidates chosen here and the candidates chosen in the preliminary selection process (A) are subjected to the final selection process in (E). However, it is preferable that the value of Y be fixed at a preset value in the preliminary selection process in (D1) and Y candidates that yield smallest approximate code amounts be chosen as the candidates to be subjected to the final selection process in (E) because the amount of computation of the (E) final selection process is large.

(D2—Step S732) If a frame for which the interval T is to be determined is not the temporally first frame, the interval determination unit 7 performs the preliminary selection process described above on at most $Z_2$+Q+Y+W candidates included in a union $S_{Z3} \cup S_P$ (where $|S_P|$=Y+W). The union $S_{Z3} \cup S_P$ will be described here. A frame for which the interval T is to be determined is denoted by $X_t$ and the frame temporally immediately preceding the frame $X_t$ is denoted by $X_{t-1}$. The set $S_{Z3}$ is a set of candidates in the frame $X_t$ obtained in the processes (A)-(B) described above and the number of the candidates included in the set $S_{Z3}$ is $Z_2$+Q. The set $S_P$ is the union of a set $S_Y$ of candidates chosen as the candidates to be subjected to the final selection process in (E), which will be described later, when the interval T is determined in the frame $X_{t-1}$ and a set $S_W$ of candidates to be added to the set $S_Y$ by an adding process in (C), which will be described later. The set $S_Y$ has been stored in a memory. Here, $|S_Y|$=Y and $|S_W|$=W and at least $S_{Z3} \cup S_P|<Z$ needs to be satisfied. The preliminary selection process described above is performed on at most $Z_2$+Q+Y+W candidates included in the union $S_{Z3} \cup S_P$. The number of candidates reduced by the preliminary selection process is Y and Y satisfies $Y<|S_{Z3} \cup S_P| \leq Z_2+Q+Y+W$. Various kinds of preliminary selection processes are possible as stated earlier. For example, the same process as the preliminary selection process in (B) described above may be performed (the number of output candidates differs (that is, $Y \neq Z_2$)). It should be noted that in this case the value of Y can vary from frame to frame. In a preliminary selection process different from the preliminary selection process in (B) described above, rearranging described above is performed on the sample string on the basis of each of $|S_{Z3} \cup S_P|$ candidates, for example, and a predetermined approximation equation for approximating the code amount of a code string obtained by encoding the rearranged sample string is used to obtain an approximate code amount (an estimated code amounts). The rearranging of the sample string is performed by the rearranging unit 5. For candidates for which a rearranged sample string has been obtained in the preliminary selection process in (A), the rearranged sample string obtained in the preliminary selection process in (A) may be used. In that case, if the value of Y is not preset, candidates that yield approximate amounts of code less than or equal to a predetermined threshold may be chosen as the candidates to be subjected to the (E) final selection process, which will be describe later (in this case, the number of chosen candidates is Y); if the value of Y is preset, Y candidates that yield smallest approximate code amounts may be chosen as the candidates to be subjected to the (E) final selection process, which will be described later. The Y candidates are stored in a memory and are used in the process in (D2), which is performed when determining the interval T in the temporally next frame. After the process in (D2), the final selection process in (E) is performed.

If the same preliminary selection process as the preliminary selection process in (A) is performed in (D2) and candidates are chosen by comparison between an indicator relating to the code amount of a code string obtained by encoding the rearranged sample string in the preliminary selection process in (A) and a threshold, the candidates chosen in the preliminary selection process in (A) are always chosen in the preliminary selection process in (D2). Therefore, the process of comparing the indicator with the threshold to choose candidates need to be performed for only the candidates added in the adding process (B), the candidates subjected to the final selection process in (E), which will be described later, when the interval T is determined in the frame $X_{t-1}$, and the candidates added in the adding process in (C), and the candidates chosen here and the candidates chosen in the preliminary selection process (A) are subjected to the final selection process in (E). However, it is preferable that the value of Y be fixed at a preset value in the preliminary selection process in (D2) and Y candidates that yield smallest approximate code amounts be chosen as the candidates to be subjected to the final selection process in (E) because the amount of computation of the (E) final selection process is large.

(C) Adding Process (Step S74)

The interval determination unit 7 performs a process of adding one or more candidates to the set $S_Y$ subjected to the final selection process in (E), which will be described below, when the interval T is determined in the frame $X_{t-1}$. The candidates added to the set $S_Y$ may be the candidates $T_{m-1}$ and $T_{m+1}$ preceding and succeeding a candidate $T_m$ included in the set $S_Y$, for example, where $T_{m-1}, T_{m+1} \in S_Z$ (here, the candidates "preceding and succeeding" the candidate $T_m$ are the candidates preceding and succeeding the $T_m$ in the order $T_1<T_2<\ldots<T_Z$ based on the magnitude of value introduced in the set $S_Z=\{T_1, T_2, \ldots, T_Z\}$). It only needs to choose candidates to be added from the set $S_Z$. For example, for a candidate $T_m$ included in the set $S_Y$, $T_m-\gamma$ (where $T_m-\gamma \in S_Z$) and/or $T_m+\eta$ (where $T_m+\eta \in S_Z$) may be added as new candidates. Here, $\gamma$ and $\eta$ are predetermined positive real numbers, for example and $\gamma$ may be equal to $\eta$. If $T_m-\gamma$ and/or $T_m+\eta$ overlaps another candidate included in the set $S_Y$, $T_m-\gamma$ and/or $T_m+\eta$ is not added (because there is no point in adding them). Then, a process in (D2) is performed.

(E) Final Selection Process (Step S75)

The interval determination unit 7 rearranges the sample string on the basis of each of the Y candidates as described above, encodes the rearranged sample string to obtain a code string, obtains actual code amounts, and chooses a candidate that yields the smallest code amount as the interval T. The rearranging is performed by the rearranging unit 5 and the encoding of the rearranged sample string is performed by the encoding unit 6. For candidates for which a rearranged sample string has been obtained in the preliminary selection process in (A) or (D), the rearranged sample string obtained in the preliminary selection process may be input in the encoding unit 6 and encoded by the encoding unit 6.

Note that the adding process in (B), the adding process in (C) and the preliminary selection process in (D) are not essential and at least any one of the processes may be omitted. If the adding process in (B) is omitted, then the number $|S_{Z3}|$ of the elements (candidates) of the set $S_{Z3}$ is $|S_{Z3}|=Z_2$ since Q=0. If the preliminary selection process in (D) is omitted, then at most $Z_2+Q$ candidates included in the set $S_{Z3}$ (if the frame for which the interval T is to be determined is the temporally first frame) or at most $Z_2+Q+Y+W$ candidates included in the union $S_{Z3} \cup S_P$ (if the frame for which the interval T is to be determined is not the temporally first frame) are subjected to the final selection process in (E).

Figure 9:
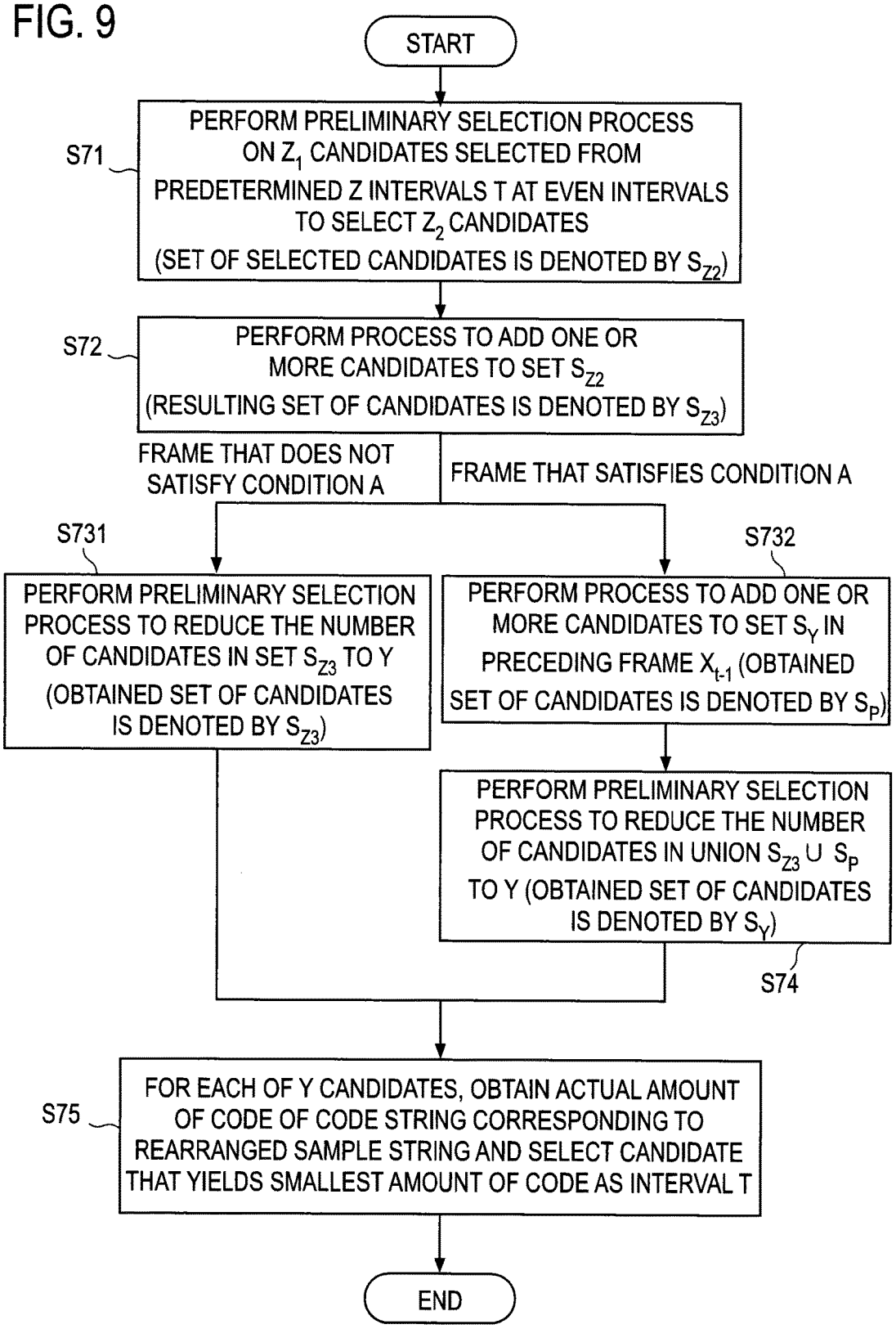
FIG. 9 is a diagram illustrating a modification of the process procedure for determining an interval T.

While the "first frame" is the "temporally first frame" in the description of determination of the interval T, the first frame is not limited to this. The "first frame" may be any frame other than the frames that satisfies conditions (1) to (3) listed in Conditions A below (see FIG. 9).

<Conditions A>

For a frame, (1) the frame is not the temporally first frame, (2) the preceding frame has been encoded according to an encoding method of the present invention, and (3) the preceding frame has undergone the rearranging process described above.

While the set $S_Y$ in the process in (D2) is a "set of candidates subjected to the final selection process in (E) described later when the interval T is determined in the preceding frame $X_{t-1}$" in the foregoing description, the set $S_Y$ may be the "union of sets of candidates subjected to the final selection process in (E) described later when determining the interval T in each of a plurality of frames preceding in time the frame for which the interval T is to be determined." Specifically, the set $S_Y$ is the union of a set $S_{t-1}$ of candidates subjected to the final selection process in (E) described later when determining the interval T in the frame $X_{t-1}$, a set $S_{t-2}$ of candidates subjected to the final selection process in (E) described later when determining the interval for frame $X_{t-2}, \ldots$, and a set $S_{t-m}$ of candidates subjected to the final selection process described later when determining the interval T in frame $X_{t-m}$, that is, $S_Y=S_{t-1} \cup S_{t-2} \cup \ldots \cup S_{t-m}$, where m is the number of previous frames. Here, m is preferably any one of 1, 2 and 3 because a larger value of m requires an increased amount of computation, depending on the values Z, $Z_1$, $Z_2$ and Q.

Assuming that the amount A of computation for the preliminary selection process is about 1/10 of this amount of computation for the process of calculating the code amount, that is, A/10, then the amount of computation required for performing the processes (A), (B), (C) and (D2) is at most $((Z_1+Z_2+Q+Y+W)A/10+YA)$ if Z, $Z_1$, $Z_2$, Q, W and Y are preset to fixed values. Here, letting $Z_2+Q \approx 3Z_2$ and $Y+W \approx 3Y$, then the amount of computation is $((Z_1+3Z_2+3Y)A/10+YA)$. Comparison with the amount of computation (ZA/10+YA) described above shows that the amount of computation can be reduced by setting Z, $Z_1$, $Z_2$ and Y that satisfy $Z>(Z_1+3Z_2+3Y)$. For example, settings may be Z=256, $Z_1$=64 and $Z_2$=Y=8.

$S_Z=\{T_1, T_2, \ldots, T_Z\}$ may be constant or vary from frame to frame. The value of Z may be constant or vary from frame to frame. However, the number of candidates to be subjected to the final selection process in (E) needs to be smaller than Z. Therefore, if $|S_Y|$ is greater than or equal to Z in the process in (D2), preliminary selection process is performed on the set $S_Y$ read from a memory, for example, by using an indicator similar to the indicator used in the preliminary selection process in (A) described above to reduce the number of candidates so that the number of candidates to be subjected to the final selection process in (E) is smaller than Z. If the preliminary selection process in (D) is omitted and $|S_{Z3} \cup S_P| \geq Z$, preliminary selection is performed on $S_{Z3} \cup S_P$ by using an indicator similar to the indicator used in the preliminary selection process in (A) described above to reduce the number of candidates so that the number of candidate to be subjected to the final selection process in (E) is smaller than Z.

<Modification of Method for Determining Interval T>

In an audio signal such as speech and music signals, there is often a high correlation between the current frame and previous frames in a signal period where the audio signal is in a stationary state across a plurality of frames. By taking advantage of this nature of a stationary signal, the ratio between $S_{Z3}$ and $S_P$ can be changed in the process in (D2) to further reduce the amount of computation while maintaining compression performance. The ratio here may be specified as the ratio of $S_P$ to $S_{Z3}$ or may be specified as the ratio of $S_{Z3}$ to $S_P$, or may be specified as the proportion of $S_P$ in $S_{Z3} \cup S_P$, or may be specified as the proportion of $S_{Z3}$ in $S_{Z3} \cup S_P$.

Determination as to whether stationarity is high or not in a certain signal segment can be made on the basis of whether or not an indicator, for example, indicating the degree of stationarity is greater than or equal to a threshold, or whether or not the indicator is greater than a threshold. The indicator indicating the degree of stationarity may be the one given below. A frame of interest for which the interval T is determined is hereinafter referred to as the current frame and the frame immediately preceding the current frame in time is referred to as the preceding frame. The indicator of the degree of stationarity is larger when:

(a-1) "prediction gain of an audio signal in the current frame" is larger, (a-2) "estimated prediction gain of an audio signal in the current frame" is larger, (b-1) difference between the "prediction gain of an audio signal in the preceding frame" and the "prediction gain of the audio signal in the current frame" is smaller, (b-2) difference between the "estimated prediction gain of an audio signal in the preceding frame" and the "estimated prediction gain of the audio signal in the current frame" is smaller, (c-1) "sum of the amplitudes of samples of an audio signal included in the current frame" is larger, (c-2) "sum of the amplitudes of samples included in a sample string obtained by transforming a sample string of an audio signal included in the current frame into a frequency domain" is larger, (d-1) difference between the "sum of the amplitudes of samples in an audio signal included in the preceding frame" and the "sum of the amplitudes of samples of the audio signal included in the current frame" is smaller, (d-2) difference between the "sum of the amplitudes of samples of an audio signal included in a sample string obtained by transforming a sample string of the audio signal included in the preceding frame into a frequency domain" and the "sum of the amplitudes of samples included in a sample string obtained by transforming a sample string of an audio signal included in the current frame into a frequency domain" is smaller, (e-1) "power of an audio signal in the current frame" is greater, (e-2) "power of a sample string obtained by transforming a sample string of an audio signal in the current frame into a frequency domain" is greater, (f-1) difference between the "power of an audio signal in the preceding frame" and the "power of the audio signal in the current frame" is smaller, and/or (f-2) difference between the "power of a sample sting obtained by transforming a sample string of an audio signal in the preceding frame into a frequency domain" and the "power of a sample string obtained by transforming a sample string of the audio signal in the current frame into a frequency domain" is smaller.

Note that the predicative gain is the ratio of the energy of an original signal to the energy of a prediction error signal in predictive coding. The value of the predicative gain is substantially proportional to the ratio of the sum of the absolute values of values of samples included in an MDCT coefficient string in the frame output from the frequency-domain transform unit 1 to the sum of the absolute values of values of samples included in a weighted normalized MDCT coefficient string in the frame output from the weighted envelope normalization unit 2, or the ratio of the sum of the squares of values of samples included in an MDCT coefficient string in the frame to the sum of squares of values of samples included in a weighted normalized MDCT coefficient string in the frame. Therefore, any of these ratios can be used as a value whose magnitude is equivalent to the magnitude of "prediction gain of an audio signal in a frame".

"Prediction gain of an audio signal in a frame" is E given by $$E = 1 \Big/ \prod_{m=1}^{P} (1 - k_m^2)$$

where $k_m$ is an m-th order PARCOR coefficient corresponding to a linear predictive coefficient in the frame used by the weighted envelope normalization unit 2. Here, the PARCOR coefficient corresponding to the linear predictive coefficient is an unquantized PARCOR coefficient of all orders. If E is calculated by using an unquantized PARCOR coefficient of some orders (for example the first to $P_2$-th order, where $P_2<P_O$) or a quantized PARCOR coefficient of some or all orders as a PARCOR coefficient corresponding to the linear predictive coefficient, the calculated E will be an "estimated prediction gain of an audio signal in a frame".

The "sum of the amplitudes of samples of an audio signal include in a frame" is the sum of the absolute values of sample values of a speech/audio digital signal included in the frame or the sum of the absolute values of sample values included in an MDCT coefficient string in the frame output from the frequency-domain transform unit 1.

The "power of an audio signal in a frame" is the sum of the squares of sample values of a speech/audio digital signal included in the frame, or the sum of squares of sample values included in an MDCT coefficient string in the frame output from the frequency-domain transform unit 1.

Any one of (a) to (f) given above may be used for determining the degree of stationarity or the logical OR or AND of two or more of (a) to (f) given above may be used for determining the degree of stationarity. In the former case, the interval determination unit 7 uses for example (a) "prediction gain of an audio signal in the current frame" alone and, if $\epsilon<G$ holds between the "prediction gain of the audio signal in the current frame" G and a predetermined threshold $\epsilon$, determines that the stationarity is high, or the interval determination unit 7 uses for example only (b) the difference $G_{off}$ between the "prediction gain of an audio signal in the preceding frame" and the "prediction gain of an audio signal in the current frame" and, if $G_{off}<$holds between the difference $G_{off}$ and a predetermined threshold $\tau$, determines that the stationarity is high. In the latter case, the interval determination unit 7 uses for example criteria (c) and (e) and, if $\zeta<Ac$ holds between the "sum of the amplitudes of samples of an audio signal included in the current frame" Ac and a predetermined threshold and $\zeta<\epsilon<Pc$ holds between the "power of an audio signal in the current frame" Pc and a predetermined threshold $\delta$, determines that the stationarity is high, or the interval determination unit 7 uses criteria (a), (c) and (f) and, if $\epsilon<G$ holds between the "prediction gain of an audio signal in the current frame" G and a predetermined threshold $\epsilon$ or $\zeta<Ac$ holds between the "sum of the amplitudes of samples of an audio signal included in the current frame" Ac and a predetermined threshold $\zeta$ and $P_{off}<\theta$ holds between the difference $P_{off}$ between the "power of an audio signal in the preceding frame" and the "power of the audio signal in the current frame" and a predetermined threshold $\theta$, determines that the stationarity is high.

The ratio between $S_{Z3}$ and $S_P$ which is changed depending on the determination of the degree of stationarity is specified in advance in a lookup table, for example, in the interval determination unit 7. Typically, when stationarity is determined to be high, the ratio of $S_P$ in $S_{Z3} \cup S_P$ is set to a large value (the ratio of $S_{Z3}$ is relatively low or the ratio of $S_P$ in $S_{Z3} \cup S_P$ is greater than 50%), or when stationarity is determined to be not high, the ratio of $S_P$ in $S_{Z3} \cup S_P$ is set to a low value (the ratio of $S_{Z3}$ is relatively high or the ratio of $S_P$ in $S_{Z3} \cup S_P$ does not exceed 50%) or the ratio is about 50:50. When stationarity is determined to be high, the lookup table is referenced to determine the ratio of $S_P$ (or the ratio of $S_{Z3}$) in the process in (D2) and the number of candidates in a set $S_{Z3}$ is reduced by choosing candidates with larger indicators as in the preliminary selection process in (A) described above, for example, so that the numbers of candidates included in $S_P$ and $S_{Z3}$ agree with the ratio. On the other hand, when stationarity is determined to be not high, the lookup table is referenced to determine the ratio of $S_P$ (or the ratio of $S_{Z3}$) and the number of candidates included in the set $S_P$ is changed by choosing candidates with larger indicators in the same way as in the process (A) described above, for example, so that the numbers of candidates include in $S_P$ and $S_{Z3}$ agree with the ratio. In this way, the number of candidates to be subjected to the process in (D2) can be reduced while the ratio of the set to which interval T for the current frame is likely to be included as a candidate can be increased. Thus, the interval T can be efficiently determined. Note that if stationarity is determined to be not high, $S_P$ may be an empty set. That is, candidates chosen to be subjected to the final selection process in (E) in a previous frame is excluded from the candidates to be subject to the preliminary selection process in (D) in the current frame.

In an alternative configuration, different ratios between $S_{Z3}$ and $S_P$ that depend on the degree of stationarity may be set. For example, determination as to whether stationarity is high or not is made by using only criterion (a) "prediction gain of an audio signal in the current frame", a plurality of thresholds $\epsilon_1, \epsilon_2, \ldots, \epsilon_k$ (where $\epsilon_1<\epsilon_2< \ldots <\epsilon_{k-1}<\epsilon_k$) are provided for "prediction gain of an audio signal in the current frame" Gin advance and $$G < \varepsilon_1 \Rightarrow \text{ratio of } S_P \text{ in } S_{Z3} \cup S_P : 10\%$$

$$\varepsilon_1 \le G < \varepsilon_2 \Rightarrow \text{ratio of } S_P \text{ in } S_{Z3} \cup S_P : 20\%$$

$$\ldots$$

$$\varepsilon_{k-1} \le G < \varepsilon_k \Rightarrow \text{ratio of } S_P \text{ in } S_{Z3} \cup S_P : 80\%$$

$$\varepsilon_k \le G \Rightarrow \text{ratio of } S_P \text{ in } S_{Z3} \cup S_P : 90\%$$

are specified in a lookup table in advance. While an example in which only criterion (a) "prediction gain of an audio signal in the current frame" is used has been described here, different ratios between $S_{Z3}$ and $S_P$ depending on the degree of stationarity can be set in a lookup table for other criteria or logical OR or AND of two or more of criteria (a) to (f).

While an exemplary embodiment has been described in which the ratio between $S_{Z3}$ and $S_P$ is changed according to the determination of the degree of stationarity after sets $S_{Z3}$ and $S_P$ have been determined in the process in (D2), determination as to whether the degree of stationarity is high or not may be made before sets $S_{Z3}$ and $S_P$ are determined in an alternative embodiment. For example, values of $Z_1$, $Z_2$, Q and W according to the determination of whether the degree of stationarity is high or not may be set in a lookup table in association with values of Y in advance. At least one of values of $Z_1$, $Z_2$ and Q (preferably $Z_2$ or Q) associated with determination that stationarity is high is set small (or W is set to large) so that $|S_{Z3}|$ is smaller than the value of Y+W (where W may be equal to 0). At least one of values of $Z_1$, $Z_2$ and Q (preferably $Z_2$ or Q) associated with determination that stationarity is not high is set large (or W is set small) so that $|S_{Z3}|$ is larger than the value of Y+W (where W may be equal to 0).

In an embodiment in which determination as to whether stationarity is high or not is made before determining sets $S_{Z3}$ and $S_P$, values of $Z_1$, $Z_2$ and Q according to the degree of stationarity can be set in a lookup table. For example, if determination as to whether stationarity is high or low is made by using only the criterion (a) "prediction gain of an audio signal in the current frame", a plurality of thresholds $\epsilon_1, \epsilon_2, \epsilon_{k-1}, \epsilon_k$ (where $\epsilon_1<\epsilon_2<\epsilon_{k-1}<\epsilon_k$) are provided for the "prediction gain of an audio signal in the current frame" G in advance and $$G < \varepsilon_1 \Rightarrow Z_2 = 16,\ Q = 30$$

$$\varepsilon_1 \le G < \varepsilon_2 \Rightarrow Z_2 = 12,\ Q = 20$$

$$\ldots$$

$$\varepsilon_{k-1} \le G < \varepsilon_k \Rightarrow Z_2 = 4,\ Q = 4$$

$$\varepsilon_k \le G \Rightarrow Z_2 = 2,\ Q = 0$$

are specified in a lookup table in advance. While an example in which only criterion (a) "prediction gain of an audio signal in the current frame" is used has been described here, values of $Z_1$, $Z_2$ and Q that vary depending on the degree of stationarity can be set in a lookup table for other criteria or logical OR or AND of two or more of criteria (a) to (f).

[Method for Determining Periodic Feature Amount]

While a method for determining interval T with a small amount of computation has been described, a parameter to be determined by the method is not limited to interval T. For example, the method can be used for determining a periodic feature amount (for example a fundamental frequency or pitch period) of an audio signal that is information for identifying the sample groups when rearranging samples. Specifically, the interval determination unit 7 may be caused to function as a periodic feature amount determination apparatus to determine the interval T as a periodic feature amount without outputting a code string that can be obtained by encoding a rearranged sample string. In this case, the term "interval T" in the description of the "Method for Determining Interval T" can be replaced with the term "pitch period" or a sample string sampling frequency divided by the "interval T" can be replaced with "fundamental frequency". The method can determine the fundamental frequency or pitch period for rearranging samples with a small amount of computation.

[Side Information Identifying Rearranging of Samples in Sample String]

The encoding unit 6 or the side information generating unit 8 outputs the side information identifying rearranging of samples included in a sample string, that is, information indicating a periodicity of an audio signal, or information indicating a fundamental frequency, or information indicating the interval T between a sample corresponding to a periodicity or fundamental frequency of an audio signal and a sample corresponding to an integer multiple of the periodicity or fundamental frequency of the audio signal. Note that if the encoding unit 6 outputs the side information, the encoding unit 6 may perform a process for obtaining the side information in the process for encoding a sample string or may perform a process for obtaining the side information as a process separate from the encoding process. For example, if the interval T is determined for each frame, side information identifying rearranging of samples included in a sample string is output for each frame. Side information that identifies rearranging of samples in a sample string can be obtained by encoding periodicity, fundamental frequency or interval T on a frame-by-frame basis. The encoding may be fixed-length coding or may be variable-length coding to reduce the average code amount. If fixed-length coding is used, side information is stored in association with a code that uniquely identifies the side information, for example, and the code associated with input side information is output. If variable-length coding is used, the difference between the interval T in the current frame and the interval T in the preceding frame may be encoded by the variable-length coding and the resulting information may be used as the information indicating interval T. In this case, for example a difference in interval T is stored in association with a code uniquely identifying the difference and the code associated with an input difference between the interval T in the current frame and the interval T in the preceding frame is output. Similarly, the difference between the fundamental frequency of the current frame and the fundamental frequency of the preceding frame may be encoded by the variable-coding and the encoded information may be used as information indicating the fundamental frequency. Furthermore, if n can be chosen from a plurality of alternatives, the upper bound of n or the upper bound number N described earlier may be included in side information.

[The Number of Samples Collected]

While an example is given in this embodiment where the number of samples included in each sample group is fixed to three, namely a sample corresponding to a periodicity or a fundamental frequency or an integer multiple of the periodicity or fundamental frequency (hereinafter the sample referred to as center sample), the sample preceding the center sample, and the sample succeeding the center sample, if the number of samples in a sample group and sample indices are variable, information indicating one alternative selected from a plurality of alternatives in which combinations of the number of samples in a sample group and sample indices are different may be included in side information.

For example, if (1) center sample only, F(nT), (2) a total of three samples, namely a center sample, the sample preceding the center sample and the sample succeeding the center sample, F(nT−1), F(nT), F(nT+1), (3) a total of three samples, namely a center sample and the two preceding samples, F(nT−2), F(nT−1), F(nT), (4) a total of four samples, namely a center sample and the three preceding samples, F(nT−3), F(nT−2), F(nT−1), F(nT), (5) a total of three samples, namely a center sample and the two succeeding samples, F(nT), F(nT+1), F(nT+2), and (6) a total of four samples, namely a center sample and the three succeeding samples, F(nT), F(nT+1), F(nT+2), F(nT+3)

are set as alternatives and (4) is selected, information indicating that (4) is selected is included in the side information. Three bits is enough for information indicating the selected alternative in this example.

One method for choosing one of the alternatives is as follows. The rearranging unit 5 may perform rearranging corresponding to each of these alternatives and the encoding unit 6 may obtain the code amount of a code string corresponding to each of the alternatives. Then, the alternative that yields the smallest code amount may be selected. In this case, side information identifying the rearranging of samples included in a sample string is output from the encoding unit 6 instead of the rearranging unit 5. This method is also applied to a case where n can be selected from a plurality of alternatives.

However, there can be a huge number of combinations of alternatives, such as alternatives concerning interval T, alternatives concerning combinations of the number of samples included in a sample string and sample index, and alternatives concerning n. It requires a huge amount of processing to calculate the ultimate code amount from all of the combinations of alternatives, which may cause a problem from point of view of efficiency. From this point of view, preferably the following approximation process is performed to reduce the amount of processing. The encoding unit 6 obtains approximate code amounts which are estimated code amounts by a simple approximation method for all combinations of alternatives, extracts a plurality of candidates likely to be preferable, for example by choosing a predetermined number of candidates that yields smallest approximate amounts of code, and choose the alternative that yields the smallest code amount among the chosen candidates. Thus, an adequately small ultimate code amount can be achieved with a small amount of processing.

In one example, the number of samples included in a sample group may be fixed at "three", then candidates for interval T are reduced to a small number, the number of samples included in a sample group is combined with each candidate, and the most preferable alternative may be selected.

Alternatively, an approximate sum of the indicators of samples is measured and an alternative may be chosen on the basis of the concentration of the indicators of samples on a lower frequency region or on the basis of the number of successive samples that have an amplitude of zero and runs from the highest frequency toward the lower frequency side along the frequency axis. Specifically, the sum of the absolute values of the amplitudes of rearranged samples in the first ¼ region from the low frequency side of a rearranged sample string may be obtained. If the sum is greater than a predetermined threshold, the rearranging can be considered to be preferable rearranging. A method of selecting an alternative that yields the largest number of successive samples that have an amplitude of zero from the highest frequency toward the low frequency side of a rearranged sample can also be considered to be a preferable rearranging because samples having large indicators are concentrated in a low frequency region.

When alternatives are chosen by the approximation process described above, the amount of processing is small but rearranging of samples in a sample string that yields the smallest ultimate code amount cannot necessarily be chosen. Therefore, a plurality of alternatives may be selected by the approximation process described above and the amounts of codes for the small number of candidates may be ultimately precisely calculated to select the most preferable one (that yields a small code amount).

[Modification]

In some situations, there can be no advantage in rearranging of samples included in a sample string. In such a case, an original sample string needs to be encoded. The rearranging unit 5 therefore outputs an original sample string (a sample string that has not been rearranged) as well. Then the encoding unit 6 encodes the original sample string by variable-length coding. The code amount of the code string obtained by variable-length coding of the original sample string is compared with the sum of the code amount of the code string obtained by variable-length coding of the rearranged sample string and the code amount of side information.

If the code amount of the code string obtained by variable-length coding of the original sample string is smaller, the code string obtained by variable-length coding of the original sample string is output.

If the sum of the code amount of the code string obtained by variable-length coding of the rearranged sample string and the code amount of the side information is smaller, the code string obtained by the variable-length coding of the rearranged sample string and the side information is output.

If the code amount of the code string obtained by variable-length coding of the original sample string is equal to the sum of the code amount of the code string obtained by variable-length coding of the rearranged sample string and the code amount of the side information, either one of the code string obtained by variable-length coding of the original sample string and the code string obtained by variable length coding of the rearranged sample string with the side information is output. Which of these is to be output is determined in advance.

Additionally, second side information indicating whether the sample string corresponding to the code string is the rearranged sample string or not is also output (see FIG. 10). One bit is enough for the second side information.

Note that if an approximate code amount, that is, an estimated code amount, of a code string obtained by variable-length coding of a rearranged sample string is obtained as described above, the approximate code amount of the code string obtained by variable-length coding of the rearranged sample string may be used instead of the code amount of the code string obtained by variable-length coding of the rearranged sample string. Similarly, an approximate code amount, that is, an estimated code amount, of a code string obtained by variable-length coding of an original sample string may be obtained and be used instead of the code amount of the code string obtained by variable-length coding of the original sample string.

Furthermore, it is possible to predetermine to rearrange samples included in a sample string only if a prediction gain or an estimated prediction gain is greater than a predetermined threshold. This method takes advantage of the fact that when the prediction gain in speech or music is large, vocal cord vibration or vibration of a music instrument is strong and the periodicity is high. Prediction gain is the energy of original sound divided by the energy of a prediction residual. In encoding that uses linear predictive coefficients and PARCOR coefficients as parameters, quantized parameters can be used on the encoder and the decoder in common. Therefore, for example, the encoding unit 6 may use an i-th order quantized PARCOR coefficient k(i) obtained by other means, not depicted, provided in the encoder 100 to calculate an estimated prediction gain represented by the reciprocal of (1−k(i)*k(j)) multiplied for each order. If the calculated estimated value is greater than a predetermined threshold, the encoding unit 6 outputs a code string obtained by variable-encoding of a rearranged sample; otherwise, the encoding unit outputs a code string obtained by variable-encoding of an original sample string. If quantized parameters can be used on the encoder and the decoder in common as in this example, the second side information indicating whether the sample string corresponding to a code string is a rearranged sample string or not does not need to be output. That is, rearranging is likely to have a minimal effect in unpredictable noisy sound or silence and therefore rearranging is omitted to reduce waste of side information and computation.

In an alternate configuration, the rearranging unit 5 may calculate a prediction gain or an estimated prediction gain. If the prediction gain or the estimated prediction gain is greater than a predetermined threshold, the rearranging unit 5 may rearrange a sample string and output the rearranged sample string to the encoding unit 6; otherwise, the rearranging unit 5 may output a sample string input in the rearranging unit 5 to the encoding unit 6 without rearranging the sample string. Then the encoding unit 6 may encode the sample string output from the rearranging unit 5 by variable-length encoding.

In this configuration, the threshold is preset as a value common to the encoding side and decoding side.

Note that Rice coding, entropy coding and run length coding taken as an example herein are all well known and therefore detailed descriptions of these method are omitted.

Decoding Process

Figure 5:
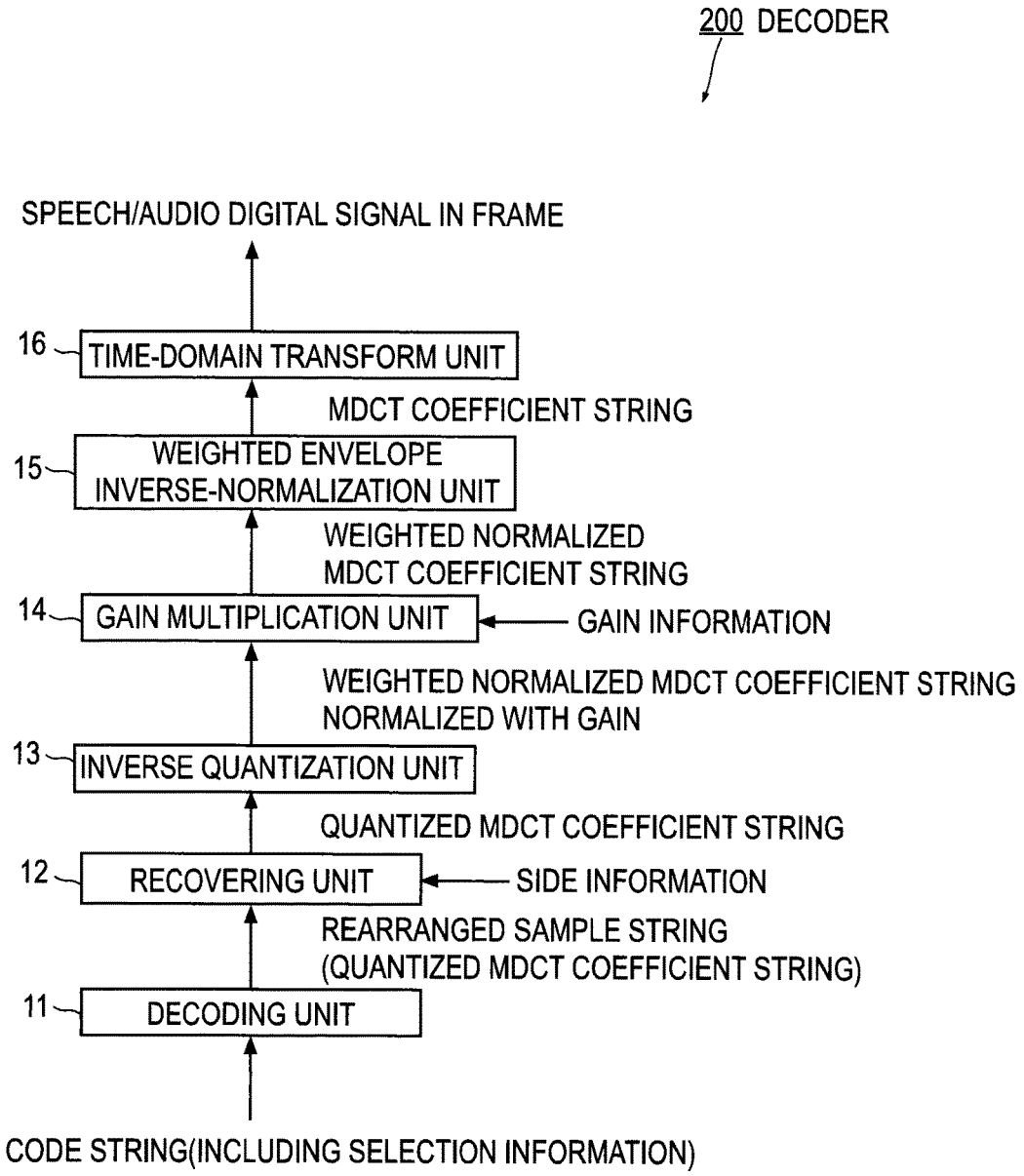
FIG. 5 is a diagram illustrating an exemplary functional configuration of an embodiment of a decoder.
Figure 6:
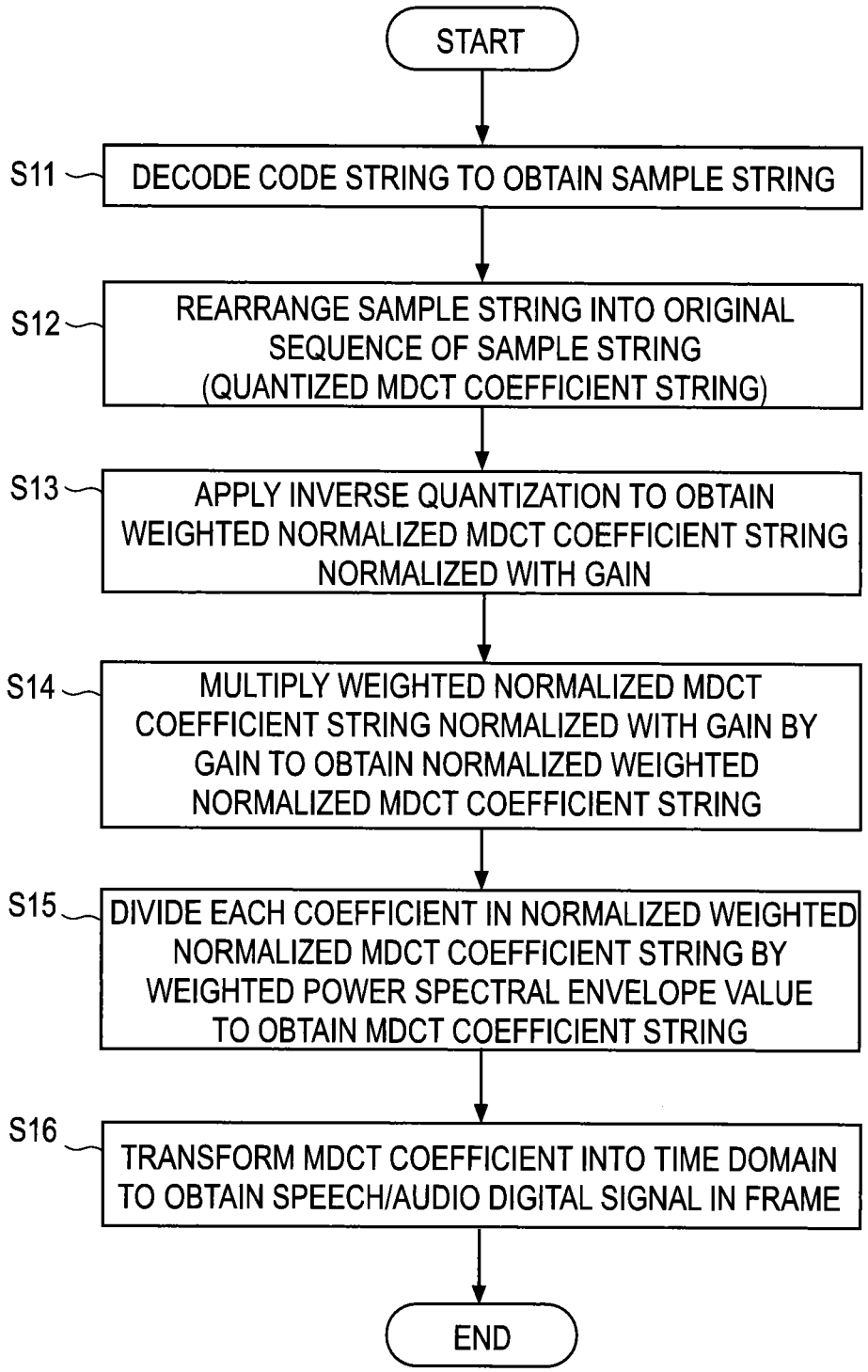
FIG. 6 is a diagram illustrating a process procedure of an embodiment of a decoding method.

A decoding process will be described next with reference to FIGS. 5 and 6.

In a decoder 200, MDCT coefficients are reconstructed by performing the reverse of the encoding process by the encoder 100 or 100*a*. At least the gain information, the side information, and the code strings described above are input in the decoder 200. If second side information is output from the encoder 100*a*, the second side information is also input in the decoder 200.

Decoding Unit 11

First, a decoding unit 11 decodes an input code string according to selection information and outputs a sample string in a frequency domain on a frame-by-frame basis (step S11). Of course, a decoding method corresponding to the encoding method performed to obtain the coding string is performed. Details of the decoding process by the decoding unit 11 corresponds to details of the encoding process by the encoding unit 6 of the encoder 100. Therefore, the description of the encoding process is incorporated here by stating that decoding corresponding to the encoding performed by the encoder 100 is the decoding process performed by the decoding unit 11, and hereby a detailed description of the decoding process will be omitted. Note that what type of encoding has been performed can be identified by selection information. If selection information includes, for example, information identifying a region where Rice coding has been applied and Rice parameters, information indicating a region where run length coding has been applied, and information identifying the type of entropy coding, decoding methods corresponding to these encoding methods are applied to the corresponding regions of input encoding strings. The decoding process corresponding to Rice coding, the decoding process corresponding to entropy coding, and the decoding process corresponding to run length coding are well known and therefore descriptions of these decoding processes will be omitted.

Recovering Unit 12

Then, a recovering unit 12 obtains the sequence of original samples from the frequency-domain sample string output from the decoding unit 11 on a frame by frame basis according to the input side information (step S12). Here, the "sequence of original samples" is equivalent to the "frequency-domain sample string" input in the rearranging unit 5 of the encoder 100. While there are various rearranging methods that can be performed by the rearranging unit 5 of the encoder 100 and various possible rearranging alternatives corresponding to the rearranging methods as stated above, only one type of rearranging, if any, has been performed on the string, and information identifying the rearranging is included in the side information. Accordingly, the recovering unit 12 can rearrange the frequency-domain sample string output from the decoding unit 11 into the original sequence of the samples on the basis of the side information.

Note that an alternative configuration is also possible in which second side information indicating whether rearranging has been performed or not is input. In this configuration, if the second side information indicating whether rearranging has been performed or not indicates that rearranging has been performed, the recovering unit 12 rearranges the frequency-domain sample string output from the decoding unit 11 into the original sequence of the samples; if the second side information indicates that rearranging has not been performed, the recovering unit 12 outputs the frequency-domain sample string output from the decoding unit 11 without rearranging.

Another alternative configuration is also possible in which determination is made on the basis of the magnitude of a prediction gain or an estimated prediction gain as to whether or not rearranging has been performed. In this configuration, the recovering unit 12 uses an i-th order quantized PARCOR coefficient k(i) input from other means, not depicted, provided in the decoder 200 to calculate an estimated prediction gain represented by the reciprocal of (1−k(i)*k(j)) multiplied for each order. If the calculated estimated value is greater than a predetermined threshold, the recovering unit 12 rearranges a frequency-domain sample string output from the decoding unit 11 into the original sequence of the samples and outputs the resulting sample string; otherwise, the recovering unit 12 outputs a sample string output from the decoding unit 111 without rearranging.

Details of the recovering process performed by the recovering unit 12 correspond to the details of the rearranging process performed by the rearranging unit 5 of the encoder 100. Therefore, the description of the rearranging process is incorporated here by stating that the recovering process performed by the recovering unit 12 is the reverse of the rearranging performed by the rearranging unit 5 (rearranging in the reverse order), and hereby the detailed description of the recovering process will be omitted. In order to facilitate the understanding of the process, one example of the recovering process corresponding to the specific example of the rearranging process described previously will be described below.

For example, in the example described previously in which the rearranging unit 5 gathers sample groups together in a cluster at the low frequency side and outputs F(T−1), F(T), F(T+1), F(2T−1), F(2T), F(2T+1), F(3T−1), F(3T), F(3T+1), F(4T−1), F(4T), F(4T+1), F(5T−1), F(5T), F(5T+1), F(1), F(T−2), F(T+2), . . . , F(2T−2), F(2T+2), . . . , F(3T−2), F(3T+2), . . . , F(4T−2), F(4T+2), . . . , F(5T−2), F(5T+2), . . . , F(jmax), the frequency-domain sample string F(T−1), F(T), F(T+1), F(2T−1), F(2T), F(2T+1), F(3T−1), F(3T), F(3T+1), F(4T−1), F(4T), F(4T+1), F(5T−1), F(5T), F(5T+1), F(1), F(T−2), F(T+2), . . . , F(2T−2), F(2T+2), . . . , F(3T−2), F(3T+2), . . . , F(4T−2), F(4T+2), . . . , F(5T−2), F(5T+2), . . . , F(jmax) output from the decoding unit 11 is input in the recovering unit 12. The side information includes information such as information concerning interval T, information indicating that n is an integer greater than or equal to 1 and less than or equal to 5, and information indicating that a sample group contains three samples. Accordingly, based on the side information, the recovering unit 12 can recover the input sample string F(T−1), F(T), F(T+1), F(2T−1), F(2T), F(2T+1), F(3T−1), F(3T), F(3T+1), F(4T−1), F(4T), F(4T+1), F(5T−1), F(5T), F(5T+1), F(1), . . . , F(T−2), F(T+2), . . . , F(2T−2), F(2T+2), . . . , F(3T−2), F(3T+2), . . . , F(4T−2), F(4T+2), . . . , F(5T−2), F(5T+2), . . . , F(jmax) to the original sequence of samples F(j) (1≤j≤jmax).

Inverse Quantization Unit 13

Then, an inverse quantization unit 13 inversely quantizes the sequence of the original samples F(j) (1≤j≤jmax) output from the recovering unit 12 on a frame-by-frame basis (step S13). Taking the example described previously, a "weighted normalized MDCT coefficient string normalized with gain" input in the quantization unit 4 of the encoder 100 can be obtained by the inverse quantization.

Gain Multiplication Unit 14

Then, a gain multiplication unit 14 multiplies, on a frame-by-frame basis, each coefficient of the "weighted normalized MDCT coefficient string normalized by gain" output from the inverse quantization unit 13 by the gain identified in the gain information described above to obtain a "normalized weighted normalized MDCT coefficient string" (step S14).

Weighted Envelope Inverse-Normalization Unit 15

Then, a weighted envelope inverse-normalization unit 15 divides, on a frame-by-frame basis, each coefficient of the "normalized weighted normalized MDCT coefficient string" output from the gain multiplication unit 14 by a weighted power spectral envelope value to obtain an "MDCT coefficient string" (step S15).

Time-Domain Transform Unit 16

Then, a time-domain transform unit 16 transforms, on a frame-by-frame basis, the "MDCT coefficient string" output from the weighted envelope inverse-normalization unit 15 into a time domain to obtain a speech/audio digital signal in the frame (step S16).

Since the processes at steps S13 through S16 are conventional processes, detailed descriptions of those processes have been omitted. Such processes are detailed in Non-patent literatures listed above, for example.

As will be apparent from the embodiment, if for example a fundamental frequency is clear, efficient encoding can be accomplished by encoding a sample string rearranged according to the fundamental frequency (that is, the average code length can be reduced). Furthermore, since samples having equal or nearly equal indicators are gathered together in a cluster in a local region by rearranging the samples included in a sample string, quantization distortion and the code amount can be reduced while enabling efficient encoding.

<Exemplary Hardware Configuration of Encoder/Decoder>

A encoder/decoder according to the embodiments described above includes an input unit to which a keyboard and the like can be connected, an output unit to which a liquid-crystal display and the like can be connected, a CPU (Central Processing Unit) (which may include a memory such as a cache memory), memories such as a RAM (Random Access Memory) and a ROM (Read Only Memory), an external storage, which is a hard disk, and a bus that interconnects the input unit, the output unit, the CPU, the RAM, the ROM and the external storage in such a manner that they can exchange data. A device (drive) capable of reading and writing data on a recording medium such as a CD-ROM may be provided in the encoder/decoder as needed. A physical entity that includes these hardware resources may be a general-purpose computer.

Programs for performing encoding/decoding and data required for processing by the programs are stored in the external storage of the encoder/decoder (the storage is not limited to an external storage; for example the programs may be stored in a read-only storage device such as a ROM.). Data obtained through the processing of the programs is stored on the RAM or the external storage device as appropriate. A storage device that stores data and addresses of its storage locations is hereinafter simply referred to as the "storage".

The storage of the encoder stores a program for rearranging samples in each sample string included in a frequency domain that is derived from a speech/audio signal and a program for encoding the rearranged sample strings.

The storage of the decoder stores a program for decoding input code strings and a program for recovering the decoded sample strings to the original sample strings before rearranging by the encoder.

In the encoder, the programs stored in the storage and data required for the processing of the programs are loaded into the RAM as required and are interpreted and executed or processed by the CPU. As a result, the CPU implements given functions (the rearranging unit and encoding unit) to implement encoding.

In the decoder, the programs stored in the storage and data required for the processing of the programs are loaded into the RAM as required and are interpreted and executed or processed by the CPU. As a result, the CPU implements given functions (the decoding unit and recovering unit) to implement decoding.

<Addendum>

The present invention is not limited to the embodiments described above and modifications can be made without departing from the spirit of the present invention. Furthermore, the processes described in the embodiments may be performed not only in time sequence as is written or may be performed in parallel with one another or individually, depending on the throughput of the apparatuses that perform the processes or requirements.

If processing functions of any of the hardware entities (the encoder/decoder) described in the embodiments are implemented by a computer, the processing of the functions that the hardware entities should include is described in a programs. The program is executed on the computer to implement the processing functions of the hardware entity on the computer.

The programs describing the processing can be recorded on a computer-readable recording medium. The computer-readable recording medium may be any recording medium such as a magnetic recording device, an optical disc, a magneto-optical recording medium, and a semiconductor memory. Specifically, for example, a hard disk device, a flexible disk, or a magnetic tape may be used as a magnetic recording device, a DVD (Digital Versatile Disc), a DVD-RAM (Random Access Memory), a CD-ROM (Compact Disc Read Only Memory), or a CD-R (Recordable)/RW (ReWritable) may be used as an optical disk, MO (Magnet-Optical disc) may be used as a magneto-optical recoding medium, and an EEP-ROM (Electronically Erasable and Programmable Read Only Memory) may be used as a semiconductor memory.

The program is distributed by selling, transferring, or lending a portable recording medium on which the program is recorded, such as a DVD or a CD-ROM. The program may be stored on a storage device of a server computer and transferred from the server computer to other computers over a network, thereby distributing the program.

A computer that executes the program first stores the program recorded on a portable recording medium or transferred from a server computer into a storage device of the computer. When the computer executes the processes, the computer reads the program stored on the recording medium of the computer and executes the processes according to the read program. In another mode of execution of the program, the computer may read the program directly from a portable recording medium and execute the processes according to the program or may execute the processes according to the program each time the program is transferred from the server computer to the computer. Alternatively, the processes may be executed using a so-called ASP (Application Service Provider) service in which the program is not transferred from a server computer to the computer but process functions are implemented by instructions to execute the program and acquisition of the results of the execution. Note that the program in this mode encompasses information that is provided for processing by an electronic computer and is equivalent to the program (such as data that is not direct commands to a computer but has the nature that defines processing of the computer).

While the hardware entities are configured by causing a computer to execute a predetermined program in the embodiments described above, at least some of the processes may be implemented by hardware.

What is claimed is:

1. A computer-implemented encoding method for encoding a sample string in a frequency domain that is derived from an audio signal in frames, executing on a processor, the method comprising:

a step of receiving the sample string of the audio signal in the time-domain;

a step of transforming the audio signal in the time-domain to the frequency-domain;

an interval determination step of determining an interval T between samples from a set S of candidates for the interval T, the interval T corresponding to a periodicity of the audio signal or to an integer multiple of a fundamental frequency of the audio signal;

a side information generating step of encoding the interval T determined at the interval determination step to obtain side information;

outputting the side information to a decoder;

a sample string encoding step of encoding a rearranged sample to obtain a code string, the rearranged sample string (1) including all of the samples in the sample string, and (2) being a sample string in which at least some of the samples are rearranged so that all or some of one or a plurality of successive samples including a sample corresponding to the periodicity or the fundamental frequency of the audio signal in the sample string and one or a plurality of successive samples including a sample corresponding to an integer multiple of the periodicity or the fundamental frequency of the audio signal in the sample string are gathered together into a cluster on the basis of the interval T determined by the interval determination step;

wherein the interval determination step determines the interval T from a set S of candidates for the interval T, the set S being made up of Y candidates among Z candidates for the interval T, the Y candidates including $Z_2$ candidates selected without depending on a previous candidate for the interval T corresponding to a periodicity of the audio signal or to an integer multiple of a fundamental frequency of the audio signal, the previous candidate subjected to the interval determination step in a previous frame a predetermined number of frames before the current frame and including the previous candidate subjected to the interval determination step in the previous frame the predetermined number of frames before the current frame, the Z candidates being representable with the side information, where $Z_2<Z$ and $Y<Z$; and outputting the code string to the decoder, wherein the code string has a compressed amount of data compared to the received sample string of the audio signal, and the decoder is configured to reproduce a sample string of an audio signal in the time-domain based on the code string and the side information.

2. The encoding method according to claim 1, wherein the interval determination step further comprises an adding step of adding to the set S a value adjacent to the previous candidate subjected to the interval determination step in a previous frame the predetermined number of frames before the current frame and/or a value having a predetermined difference from the candidate.

3. The encoding method according to claim 1 or 2, wherein the interval determination step further comprises a preliminary selection step of selecting some of $Z_1$ candidates among the Z candidates for the interval T representable with the side information as the $Z_2$ candidates on the basis of an indicator obtainable from the audio signal and/or sample string in the current frame, where $Z_2<Z_1$.

4. The encoding method according to claim 1 or 2, wherein the interval determination step further comprises:

a preliminary selection step of selecting some of $Z_1$ candidates among the Z candidates for the interval T representable with the side information on the basis of an indicator obtainable from the audio signal and/or sample string in the current frame; and a second adding step of selecting, as the $Z_2$ candidates, a set of a candidate selected at the preliminary selection step and a value adjacent to the candidate selected at the preliminary selection step and/or a value having a predetermined difference from the candidate selected at the preliminary selection step.

5. The encoding method according to claim 1 or 2, wherein the interval determination step comprises:

a second preliminary selection step of selecting some of candidates for the interval T that are included in the set S on the basis of an indicator obtainable from the audio signal and/or sample string in the current frame; and a final selection step of determining the interval T from a set made up of some of the candidates selected at the second preliminary selection step.

6. The encoding method according to claim 1, wherein the greater an indicator indicating the degree of stationarity of the audio signal in the current frame, the greater the proportion of candidates subjected to the interval determination step in the previous frame the predetermined number of frames before the current frame to the set S is.

7. The encoding method according to claim 1, wherein when an indicator indicating the degree of stationarity of the audio signal in the current frame is smaller than a predetermined threshold, only the $Z_2$ candidates are included in the set S.

8. The encoding method according to claim 6 or 7, wherein the indicator indicating the degree of stationarity of the audio signal in the current frame increases when at least one of the following conditions occurs:

(a-1) that a prediction gain of the audio signal in the current frame increases, (a-2) that an estimated prediction gain of the audio signal in the current frame increases, (b-1) that the difference between a prediction gain of the audio signal in the frame immediately preceding the current frame and the prediction gain of the audio signal in the current frame decreases, (b-2) that the difference between an estimated prediction gain in the immediately preceding frame and the estimated prediction gain in the current frame decreases, (c-1) that the sum of amplitudes of samples of the audio signal included in the current frame increases, (c-2) that the sum of amplitudes of samples included in a sample string obtained by transforming a sample string of the audio signal included in the current frame into a frequency domain increases, (d-1) that the difference between the sum of amplitudes of samples of the audio signal included in the immediately preceding frame and the sum of amplitudes of samples of the audio signal included in the current frame decreases, (d-2) that the difference between the sum of amplitudes of samples included in a sample string obtained by transforming a sample string of the audio signal included in the immediately preceding frame into a frequency domain and the sum of amplitudes of samples included in a sample string obtained by transforming a sample string of the audio signal included in the current frame into a frequency domain decreases, (e-1) that power of the audio signal in the current frame increases, (e-2) that power of a sample string obtained by transforming a sample string of the audio signal in the current frame into a frequency domain increases, (f-1) that the difference between power of the audio signal in the immediately preceding frame and power of the audio signal in the current frame decreases, and (f-2) that the difference between power of a sample string obtained by transforming a sample string of the audio signal in the immediately preceding frame into a frequency domain and power of a sample string obtained by transforming a sample string of the audio signal in the current frame into a frequency domain decreases.

9. The encoding method according to claim 1, wherein the sample string encoding step comprises the step of outputting the code string obtained by encoding the sample string before being rearranged or the code string obtained by encoding the rearranged sample string and the side information, whichever has a smaller code amount.

10. The encoding method according to claim 1, wherein the sample string encoding step outputs the code string obtained by encoding the rearranged sample string and the side information when the sum of the code amount of or an estimated value of the code amount of the code string obtained by encoding the rearranged sample string and the code amount of the side information is smaller than the code amount of or an estimated value of the code amount of the code string obtained by encoding the sample string before being rearranged, and outputs the code string obtained by encoding the sample string before being rearranged when the code amount of or an estimated value of the code amount of the code string obtained by encoding the sample string before being rearranged is smaller than the sum of the code amount of or an estimated value of the code amount of the code string obtained by encoding the rearranged sample string and the code amount of the side information.

11. The encoding method according to claim 9 or 10, wherein the proportion of candidates subjected to the interval determination step in the previous frame the predetermined number of frames before the current frame to the set S is greater when a code string output in the immediately preceding frame is a code string obtained by encoding a rearranged sample string than when a code string output in the immediately preceding frame is a code string obtained by encoding a sample string before being rearranged.

12. The encoding method according to claim 9 or 10, wherein when a code string output in the immediately preceding frame is a code string obtained by encoding a sample string before being rearranged, the set S includes only the $Z_2$ candidates.

13. The encoding method according to claim 9 or 10, wherein when the current frame is a temporally first frame, or when the immediately preceding frame is coded by an encoding method different from the encoding method, or when a code string output in the immediately preceding frame is a code string obtained by encoding a sample string before being rearranged, the set S includes only the $Z_2$ candidates.

14. A computer-implemented method for determining a periodic feature amount of an input audio signal in frames, executing on a processor, the method comprising:

a step of receiving the audio signal in the time-domain;

a step of transforming the audio signal in the time-domain to the frequency-domain;

a periodic feature amount determination step of determining a periodic feature amount of the audio signal from a set of candidates for the periodic feature amount of the audio signal on a frame-by-frame basis;

outputting the periodic feature amount of the audio signal;

a side information generating step of encoding the periodic feature amount obtained at the periodic feature amount determination step to obtain side information; and outputting the side information, wherein the periodic feature amount determination step determines a periodic feature amount of the audio signal from a set S of candidates for the periodic feature amount of the audio signal, the set S being made up of Y candidates among Z candidates for the periodic feature amount of the audio signal, the Y candidates including $Z_2$ candidates selected without depending on a previous candidate for the periodic feature amount of the audio signal, the previous candidate subjected to the periodic feature amount determination step in a previous frame a predetermined number of frames before the current frame and including the previous candidate subjected to the periodic feature amount determination step in the previous frame the predetermined number of frames before the current frame, the Z candidates being representable with the side information, where $Z_2<Z$ and $Y<Z$;

wherein the periodic feature amount of the audio signal is a fundamental frequency or pitch period of the audio signal, wherein the side information is configured to be outputted to a decoder along with a code string, the code string being generated by encoding a rearranged sample of the audio signal and having a compressed amount of data compared to the received sample string of the audio signal, and the decoder is configured to reproduce a sample string of an audio signal in the time-domain based on the code string and the side information.

15. The periodic feature amount determination method according to claim 14, wherein the periodic feature amount determination step further comprises an adding step of adding to the set S a value adjacent to a candidate subjected to the periodic feature amount determination step in a previous frame the predetermined number of frames before the current frame and/or a value having a predetermined difference from the candidate.

16. The periodic feature amount determination method according to claim 14, wherein the greater an indicator indicating the degree of stationarity of the audio signal in the current frame, the greater the proportion of candidates subjected to the periodic feature determination step in the previous frame the predetermined number of frames before the current frame to the set S is.

17. The periodic feature amount determination method according to claim 16, wherein when the indicator indicating the degree of stationarity of the audio signal in the current frame is smaller than a predetermined threshold, only the $Z_2$ candidates are included in the set S.

18. The periodic feature amount determination method according to claim 16 or 17, wherein the indicator indicating the degree of stationarity of the audio signal in the current frame increases when at least one of the following conditions occurs:

(a-1) that a prediction gain of the audio signal in the current frame increases, (a-2) that an estimated prediction gain of the audio signal in the current frame increases, (b-1) that the difference between a prediction gain of the audio signal in the frame immediately preceding the current frame and the prediction gain of the audio signal in the current frame decreases, (b-2) that the difference between an estimated prediction gain in the immediately preceding frame and the estimated prediction gain in the current frame decreases, (c-1) that the sum of amplitudes of samples of the audio signal included in the current frame increases, (c-2) that the sum of amplitudes of samples included in a sample string obtained by transforming a sample string of the audio signal included in the current frame into a frequency domain increases, (d-1) that the difference between the sum of amplitudes of samples of the audio signal included in the immediately preceding frame and the sum of amplitudes of samples of the audio signal included in the current frame decreases, (d-2) that the difference between the sum of amplitudes of samples included in a sample string obtained by transforming a sample string of the audio signal included in the immediately preceding frame into a frequency domain and the sum of amplitudes of samples included in a sample string obtained by transforming a sample string of the audio signal included in the current frame into a frequency domain decreases, (e-1) that power of the audio signal in the current frame increases, (e-2) that power of a sample string obtained by transforming a sample string of the audio signal in the current frame into a frequency domain increases, (f-1) that the difference between power of the audio signal in the immediately preceding frame and power of the audio signal in the current frame decreases, and (f-2) that the difference between power of a sample string obtained by transforming a sample string of the audio signal in the immediately preceding frame into a frequency domain and power of a sample string obtained by transforming a sample string of the audio signal in the current frame into a frequency domain decreases.

19. A encoder encoding a sample string in a frequency domain that is derived from an audio signal in frames, the encoder comprising a processor configured to act as:

a frequency-domain transform unit that receives the sample string of the audio signal in the time domain and transforms the audio signal in the time-domain to the frequency-domain;

an interval determination unit that determines an interval T between samples from a set S of candidates for the interval T, the interval T corresponding to a periodicity of the audio signal or to an integer multiple of a fundamental frequency of the audio signal;

a side information generating unit that encodes the interval T determined by the interval determination unit to obtain side information and outputs the side information to a decoder;

a sample string encoding unit that encodes a rearranged sample string to obtain a code string and outputs the code string to the decoder, the rearranged sample string (1) including all of the samples in the sample string, and (2) being a sample string in which at least some of the samples are rearranged so that all or some of one or a plurality of successive samples including a sample corresponding to the periodicity or the fundamental frequency of the audio signal in the sample string and one or a plurality of successive samples including a sample corresponding to an integer multiple of the periodicity or the fundamental frequency of the audio signal in the sample string are gathered together into a cluster on the basis of the interval T determined by the interval determination unit;

wherein the interval determination unit determines the interval T from a set S of candidates for the interval T, the set S being made up of Y candidates among Z candidates for the interval T, the Y candidates including $Z_2$ candidates selected without depending on a previous candidate for the interval T corresponding to a periodicity of the audio signal or to an integer multiple of a fundamental frequency of the audio signal, the previous candidate subjected to processing by the interval determination unit in a previous frame a predetermined number of frames before the current frame and including the previous candidate subjected to the processing by the interval determination unit in the previous frame the predetermined number of frames before the current frame, the Z candidates being representable with the side information, where $Z_2<Z$ and $Y<Z$, wherein the code string and the side information have a compressed amount of data compared to the received sample string of the audio signal, and the decoder is configured to reproduce a sample string of an audio signal in the time-domain based on the code string and the side information.

20. The encoder according to claim 19, wherein the sample string encoding unit outputs the code string obtained by encoding the rearranged sample string and the side information when the sum of the code amount of or an estimated value of the code amount of the code string obtained by encoding the rearranged sample string and the code amount of the side information is smaller than the code amount of or an estimated value of the code amount of the code string obtained by encoding the sample string before being rearranged, and outputs the code string obtained by encoding the sample string before being rearranged when the code amount of or an estimated value of the code amount of the code string obtained by encoding the sample string before being rearranged is smaller than the sum of the code amount of or an estimated value of the code amount of the code string obtained by encoding the rearranged sample string and the code amount of the side information.

21. A periodic feature amount determination apparatus determining a periodic feature amount of an input audio signal in frames, the apparatus comprising a processor configured to act as:

a frequency-domain transform unit that receives the sample string of the audio signal in the time domain and transforms the audio signal in the time-domain to the frequency-domain;

a periodic feature amount determination unit that determines a periodic feature amount of the audio signal from a set of candidates for the periodic feature amount on a frame-by-frame basis and outputs the periodic feature amount of the audio signal; and a side information generating unit that encodes the periodic feature amount obtained at the periodic feature amount determination unit to obtain side information and outputs the side information;

wherein the periodic feature amount determination unit determines a periodic feature amount of the audio signal from a set S of candidates for the periodic feature amount of the audio signal, the set S being made up of Y candidates among Z candidates for the periodic feature amount of the audio signal, the Y candidates including $Z_2$ candidates selected without depending on a previous candidate for the periodic feature amount of the audio signal, the previous candidate subjected to the periodic feature amount determination unit in a previous frame a predetermined number of frames before the current frame and including the previous candidate subjected to the periodic feature amount determination unit in the previous frame the predetermined number of frames before the current frame, the Z candidates being representable with the side information, where $Z_2<Z$ and $Y<Z$;

wherein the periodic feature amount of the audio signal is a fundamental frequency or pitch period of the audio signal, wherein the side information is configured to be outputted to a decoder along with a code string, the code string being generated by encoding a rearranged sample of the audio signal and having a compressed amount of data compared to the received sample string of the audio signal, and the decoder is configured to reproduce a sample string of an audio signal in the time-domain based on the code string and the side information.

22. A non-transitory computer-readable recording medium having recorded thereon a computer program for causing a computer to execute the steps of the encoding method according to claim 1 or the periodic feature amount determination method according to claim 14.

* * * * *